US012146492B2

(12) United States Patent
Montie et al.

(10) Patent No.: US 12,146,492 B2
(45) **Date of Patent: *Nov. 19, 2024**

(54) HELICAL TROCHOIDAL ROTARY MACHINES WITH IMPROVED SOLIDS HANDLING

(71) Applicant: ROTOLIPTIC TECHNOLOGIES INCORPORATED, Squamish (CA)

(72) Inventors: Greg John Montie, Squamish (CA); Peter Thomas Christopher Suke, Squamish (CA); Rogan David Milatz, Squamish (CA); Robert John Charles Pearson, Squamish (CA); Braden Adam Murphy, Calgary (CA)

(73) Assignee: Rotoliptic Technologies Incorporated, Squamish (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/570,154

(22) Filed: Jan. 6, 2022

(65) Prior Publication Data

US 2022/0220958 A1 Jul. 14, 2022

Related U.S. Application Data

(60) Provisional application No. 63/135,069, filed on Jan. 8, 2021.

(51) Int. Cl.
*F04C 2/107* (2006.01)
*F04C 15/00* (2006.01)

(52) U.S. Cl.
CPC ..... *F04C 2/1076* (2013.01); *F04C 15/0015* (2013.01); *F04C 2240/10* (2013.01); *F04C 2240/20* (2013.01); *F04C 2250/20* (2013.01)

(58) Field of Classification Search
CPC ..... F04C 2/1076; F04C 2240/10; F04C 2240/20; F04C 2250/20; F04C 15/0015
See application file for complete search history.

(56) References Cited

U.S. PATENT DOCUMENTS

| | | | |
|---|---|---|---|
| 724,994 | A | 4/1903 | Cooley |
| 1,340,625 | A | 5/1920 | Planche |
| 1,575,987 | A | 3/1926 | Gilman |
| 1,636,486 | A | 7/1927 | Planche |

(Continued)

FOREIGN PATENT DOCUMENTS

| | | | |
|---|---|---|---|
| DE | 2014499 | A1 | 10/1971 |
| EP | 1552124 | A1 | 5/2006 |

(Continued)

OTHER PUBLICATIONS

Ansdale, R., The Wankel RC Engine, (1968), p. 20.

(Continued)

*Primary Examiner* — Mary A Davis
(74) *Attorney, Agent, or Firm* — Cook Alex Ltd.

(57) ABSTRACT

Improved solids handling in rotary positive displacement machines, where the machines are based on trochoidal geometry, can be achieved through the use of solids-handling features on the surface of the rotor and/or stator and/or by the use of modified seals mounted on the rotor or stator. In at least some embodiments the rotary machines comprise a helical rotor that undergoes planetary motion relative to a helical stator.

22 Claims, 26 Drawing Sheets

(56) References Cited

U.S. PATENT DOCUMENTS

| | | | |
|---|---|---|---|
| 1,686,569 | A | 10/1928 | McMillan |
| 1,738,645 | A | 12/1929 | Gilman |
| 1,892,217 | A | 12/1932 | Moineau |
| 2,612,022 | A | 9/1952 | Keys |
| 2,919,062 | A | 12/1959 | Tryhom |
| 2,988,008 | A | 6/1961 | Wankel |
| 3,208,391 | A | 9/1965 | Lindberg |
| 3,259,113 | A | 7/1966 | Hamada |
| 3,279,388 | A | 10/1966 | Roudaut |
| 3,296,874 | A | 1/1967 | Wyczalek |
| 3,299,822 | A | 1/1967 | Payne |
| 3,302,870 | A | 2/1967 | Schell |
| 3,387,772 | A | 6/1968 | Wutz |
| 3,398,643 | A | 8/1968 | Schudt |
| 3,458,120 | A | 7/1969 | Pfaff et al. |
| 3,465,729 | A | 9/1969 | Jones |
| 3,512,904 | A | 5/1970 | Allen |
| 3,533,716 | A | 10/1970 | Grun |
| 3,728,049 | A | 4/1973 | Miller |
| 3,764,239 | A | 10/1973 | Huf |
| 3,822,972 | A | 7/1974 | Ogly et al. |
| 3,917,437 | A | 11/1975 | Link |
| 3,918,137 | A | 11/1975 | Telang et al. |
| 3,958,906 | A | 5/1976 | Catterson et al. |
| 3,990,817 | A | 11/1976 | Ruf et al. |
| 4,012,180 | A | 3/1977 | Berkowitz et al. |
| 4,018,548 | A | 4/1977 | Berkowitz |
| 4,028,021 | A | 6/1977 | Berkowitz |
| 4,061,445 | A | 12/1977 | Doshi |
| 4,118,157 | A | 10/1978 | Mayer |
| 4,144,001 | A | 3/1979 | Streicher |
| 4,182,499 | A | 1/1980 | Kemper |
| 4,218,199 | A | 8/1980 | Eiermann |
| 4,296,500 | A | 10/1981 | Monties et al. |
| 4,299,097 | A | 11/1981 | Shank et al. |
| 4,330,240 | A | 5/1982 | Eslinger |
| 4,382,755 | A | 5/1983 | Hoffmann |
| 4,395,206 | A | 7/1983 | Hoffmann |
| 4,397,619 | A | 8/1983 | Aliquander et al. |
| 4,407,639 | A | 10/1983 | Maruyama |
| 4,410,305 | A | 10/1983 | Shank et al. |
| 4,487,561 | A | 12/1984 | Eiermann |
| 4,504,202 | A | 3/1985 | Saegusa |
| 4,507,067 | A | 3/1985 | Hansen |
| 4,519,206 | A | 5/1985 | Van Michaels |
| 4,551,073 | A | 11/1985 | Schwab |
| 4,594,060 | A | 6/1986 | Schwab |
| 4,728,270 | A | 3/1988 | Hoffmann |
| 4,802,830 | A | 2/1989 | Nakajima |
| 4,934,325 | A | 6/1990 | Snyder |
| 5,027,653 | A | 7/1991 | Foran |
| 5,069,606 | A | 12/1991 | Bachellerie |
| 5,096,004 | A | 3/1992 | Ide |
| 5,127,377 | A | 7/1992 | Yang |
| 5,169,298 | A | 12/1992 | Hekman et al. |
| 5,171,138 | A | 12/1992 | Forrest |
| 5,295,814 | A | 3/1994 | Uebel |
| 5,302,096 | A | 4/1994 | Cavalleri |
| 5,318,415 | A | 6/1994 | Verhoeven |
| 5,372,107 | A | 12/1994 | Smythe |
| 5,379,736 | A | 1/1995 | Anderson |
| 5,439,359 | A | 8/1995 | Leroy et al. |
| 5,609,475 | A | 3/1997 | Eiermann |
| 6,074,184 | A | 6/2000 | Imai |
| 6,093,004 | A | 7/2000 | Varadan et al. |
| 6,120,267 | A | 9/2000 | Cunningham |
| 6,213,744 | B1 | 4/2001 | Choroszylow et al. |
| 6,236,897 | B1 | 5/2001 | Lee et al. |
| 6,530,357 | B1 | 3/2003 | Yaroshenko |
| 6,718,938 | B2 | 4/2004 | Szorenyi |
| 6,776,136 | B1 | 8/2004 | Kazempour |
| 6,923,628 | B1 | 8/2005 | Otto |
| 6,926,505 | B2 | 8/2005 | Sbarounis |
| 6,974,313 | B2 | 12/2005 | Beaudoin |
| 7,101,160 | B2 | 9/2006 | Gennami et al. |
| 7,117,839 | B2 | 10/2006 | Horstin |
| 7,395,805 | B1 | 7/2008 | MacMurray |
| 7,540,728 | B2 | 6/2009 | Gorban |
| 7,549,850 | B2 | 6/2009 | Trapalis |
| 7,553,138 | B2 | 6/2009 | Gorban |
| 7,726,115 | B2 | 6/2010 | Murrow et al. |
| 7,837,451 | B2 | 11/2010 | Wiedenhoefer et al. |
| 7,942,657 | B2 | 5/2011 | Gray |
| 8,033,802 | B2 | 10/2011 | Tekneyan et al. |
| 8,133,044 | B2 | 3/2012 | Wiedenhoefer et al. |
| 8,356,585 | B2 | 1/2013 | Hathaway et al. |
| 8,523,545 | B2 | 9/2013 | Wilbourn et al. |
| 8,523,546 | B2 | 9/2013 | Shkolnik et al. |
| 8,539,930 | B2 | 9/2013 | Gray |
| 8,539,931 | B1 | 9/2013 | Hanna |
| 8,888,474 | B2 | 11/2014 | Hohl et al. |
| 8,905,733 | B2 | 12/2014 | Guidry |
| 9,051,780 | B2 | 6/2015 | Trushin |
| 10,001,123 | B2 | 6/2018 | Kreuger |
| 10,087,758 | B2 | 10/2018 | Montie et al. |
| 10,837,444 | B2 | 11/2020 | Montie et al. |
| 10,844,720 | B2 | 11/2020 | Montie |
| 10,844,859 | B2 | 11/2020 | Montie et al. |
| 2002/0122722 | A1 | 9/2002 | Bertin et al. |
| 2003/0102629 | A1 | 6/2003 | Bhate et al. |
| 2005/0017053 | A1 | 1/2005 | Sbarounis |
| 2006/0073032 | A1 | 4/2006 | Parrett |
| 2006/0127259 | A1 | 6/2006 | Gorban |
| 2006/0233653 | A1 | 10/2006 | Trapalis |
| 2008/0031758 | A1 | 2/2008 | Rosam et al. |
| 2008/0193309 | A1 | 8/2008 | Kothnur et al. |
| 2009/0110579 | A1 | 4/2009 | Amburgey |
| 2009/0220369 | A1 | 9/2009 | Wiedenhoefer et al. |
| 2009/0241536 | A1 | 10/2009 | Gale et al. |
| 2010/0183454 | A1 | 7/2010 | Lübke et al. |
| 2011/0150685 | A1 | 6/2011 | Wilbourn et al. |
| 2011/0262291 | A1 | 10/2011 | Fleger et al. |
| 2012/0070326 | A1 | 3/2012 | Hammerbeck |
| 2012/0156078 | A1 | 6/2012 | Guidry |
| 2012/0177484 | A1 | 7/2012 | Lusted et al. |
| 2012/0240885 | A1 | 9/2012 | Horn |
| 2013/0028775 | A1 | 1/2013 | Gekht et al. |
| 2013/0064702 | A1 | 3/2013 | Hohl et al. |
| 2014/0170011 | A1 | 6/2014 | Clouzeau et al. |
| 2014/0286808 | A1 | 9/2014 | Kachele |
| 2015/0030492 | A1 | 1/2015 | Montie et al. |
| 2016/0017711 | A1 | 1/2016 | Morris |
| 2016/0141921 | A1 | 5/2016 | Kubes |
| 2017/0074100 | A1 | 3/2017 | Jarvis et al. |
| 2017/0137005 | A1 | 5/2017 | Weh et al. |
| 2017/0321697 | A1 | 11/2017 | Beinert et al. |
| 2018/0291740 | A1 | 10/2018 | Montie |
| 2018/0291900 | A1 | 10/2018 | Valkenberg et al. |
| 2020/0200008 | A1 | 6/2020 | Montie et al. |
| 2020/0200174 | A1 | 6/2020 | Montie et al. |
| 2021/0025392 | A1 | 1/2021 | Montie et al. |
| 2021/0062655 | A1 | 3/2021 | Montie et al. |
| 2021/0189880 | A1 | 6/2021 | Montie et al. |
| 2021/0199011 | A1 | 7/2021 | Montie et al. |
| 2021/0285440 | A1 | 9/2021 | Montie et al. |
| 2022/0205445 | A1* | 6/2022 | Montie ..... F04C 2/1076 |
| 2023/0098259 | A1 | 3/2023 | Montie et al. |

FOREIGN PATENT DOCUMENTS

| | | | |
|---|---|---|---|
| EP | 1988288 | B1 | 11/2008 |
| GB | 1542366 | A | 3/1979 |
| JP | H1010141265 | A1 | 5/1998 |
| JP | H275663124 | B1 | 2/2015 |
| PL | 173668 | B1 | 7/1994 |
| WO | 1993022631 | A1 | 11/1993 |
| WO | 1999056004 | A1 | 11/1999 |
| WO | 2005078239 | A1 | 8/2005 |
| WO | 2009103528 | A2 | 10/2009 |

(56) References Cited

FOREIGN PATENT DOCUMENTS

| | | | | |
|---|---|---|---|---|
| WO | 2010131103 | A2 | 3/2011 | |
| WO | WO-2018222490 | A1 * | 12/2018 | ..... F04C 2/1071 |

OTHER PUBLICATIONS

Wydra, L., The Development of Outer-Envelope Trochoidal Compressors, International Compressor Engineering Conference (1986), pp. 282-292.
Wrede et al., Recent Status of Trochoidal Type Compressors for Heat Pumps in Germany, International Compressor Engineering Conference (1986), pp. 254-282.
International Search Report and Written Opinion dated Nov. 13, 2019 issued in connection with International Application No. PCT/CA2019/051273.
International Search Report and Written Opinion dated Nov. 18, 2019 issued in connection with International Application No. PCT/CA2019/051274.
International Search Report and Written Opinion dated Nov. 19, 2019 issued in connection with International Application No. PCT/CA2019/051272.
International Preliminary Report on Patentability dated Mar. 9, 2021 issued in connection with International Application No. PCT/CA2019/051272.
International Preliminary Report on Patentability dated Mar. 9, 2021 issued in connection with International Application No. PCT/CA2019/051273.
International Preliminary Report on Patentability dated Mar. 9, 2021 issued in connection with International Application No. PCT/CA2019/051274.
UK Examination Report dated Mar. 1, 2022 issued in connection with Great Britain Application No. GB 2104634.7.
International Search Report and Written Opinion dated Mar. 29, 2022, issued in connection with International Application No. PCT/CA2022/050021.
Extended European Search Report issued on Jul. 8, 2022, in connection with European Patent Application 19860104.9.
UK Examination Report dated Jan. 19, 2023, issued in connection with Great Britain Application No. GB 2104634.7.
Extended European Search Report issued on May 16, 2022, in connection with PCT Patent Application PCT/CA2019/051274.
1 UK Examination Report dated Oct. 21, 2022, issued in connection with Great Britain Application No. GB 2104634.7.
International Preliminary Report on Patentability issued in connection with PCT Application PCT/CA2022/050021.
Examiner's Report issue Feb. 7, 2024, in connection with Canadian Application No. 3177204.
Examiner's Report issued Feb. 15, 2024, in connection with Canadian Application No. 3112348.
Om et al., Calculation for Cross Section and Area Efficiency of Progressing Cavity Pump with Hypotrochoidal Multilobe Using the Differential Geometric Envelope Approach Journal of Petroleum Science and Engineering, Elsevier, Amsterdam, NL, vol. 171, Apr. 1, 2018, pp. 211-217.
Examiner's Report issued Aug. 9, 2024, in connection with European Patent Application 19859949.0.
Examiner's Report issued Sep. 16, 2024, in connection with European Patent Application No. 19860104.9.

* cited by examiner

SECTION D-D

END VIEW

SECTIONS E-E

HELICAL TROCHOIDAL ROTARY MACHINES WITH IMPROVED SOLIDS HANDLING

CROSS-REFERENCE TO RELATED APPLICATIONS

This application is related to and claims priority benefits from U.S. Provisional Patent Application Ser. No. 63/135,069 filed Jan. 8, 2021, entitled "Helical Trochoidal Rotary Machines with Improved Solids Handling". The '069 application is incorporated by reference herein in its entirety.

FIELD OF THE INVENTION

The present invention relates to solids handling in rotary positive displacement machines where the machines are based on trochoidal geometry. In at least some embodiments the machines comprise a helical rotor that undergoes planetary motion relative to a helical stator.

Rotary machines, in which at least one rotor has planetary motion within a stator or housing, can be employed, for example, as positive displacement pumps, rotary compressors, vacuum pumps, expansion engines, and the like.

Pumps are devices that can move a working fluid from one place to another. There is a wide range of end uses for various types of pumps, including irrigation, fire-fighting, flood control, water supply, gasoline supply, refrigeration, chemical movement and sewage transfer. Rotary pumps are typically positive displacement pumps comprising a fixed housing, gears, cams, rotors, vanes and/or similar elements. Rotary pumps usually have close running clearances (only a small distance or gap between their moving and stationary parts), do not require suction or discharge valves, and are often lubricated only by the fluid being pumped.

A positive displacement pump moves fluid by trapping a volume of fluid in a chamber and forcing the trapped volume into a discharge pipe. Some positive displacement pumps employ an expanding chamber on the suction side and a decreasing chamber on the discharge side. Fluid flows into the pump intake as the chamber on the suction side expands, and the fluid flows out of the discharge pipe as the chamber collapses. The output volume is the same for each cycle of operation. An ideal positive displacement pump can produce the same flow rate at a given pump speed regardless of the discharge pressure.

Progressive cavity pumps (PCPs) are one type of rotary positive displacement machine that can offer advantages for certain applications. In PCPs, a rotor is disposed and rotates eccentrically within a helical stator cavity. The fluid to be pumped follows a helical path along the pump axis. The rotor is typically formed of rigid material and the stator (or stator lining) of resilient or elastomeric material. In some PCPs, an elastomeric stator can facilitate sealing and improve abrasion resistance. In some PCPs, the elastomeric stator can deform to partially accommodate solids in the fluid that is being pumped by the PCP.

Various classes of rotary machines based on trochoidal geometries are also known. Such rotary machines comprise a rotor or stator whose cross-section is bounded by a certain family of curves, known as trochoids or trochoidal shapes. These include rotating lobe machines with the following configurations:

(1) rotary machines in which the rotor is hypotrochoidal in cross-section, and undergoes planetary motion (spins about its axis and orbits eccentrically) within a stator that is shaped as an outer envelope of that rotor (with the rotor having one more apex or lobe than the stator cavity);

(2) rotary machines in which the stator cavity is hypotrochoidal in cross-section, and the rotor undergoes planetary motion within the stator and is shaped as the inner envelope of that stator (with the rotor having one less apex or lobe than the stator cavity);

(3) rotary machines in which the rotor is epitrochoidal in cross-section, and undergoes planetary motion within a stator that is shaped as an outer envelope of that rotor (with the rotor having one less apex or lobe than the stator cavity); and (4) rotary machines in which the stator cavity is epitrochoidal in cross-section, and the rotor undergoes planetary motion within the stator and is shaped as the inner envelope of that stator (with the rotor having one more apex or lobe than the stator cavity).

Thus, in all of these configurations, the rotor or stator is a trochoidal component, meaning it has a cross-sectional shape that is a trochoid. Generally, as used herein, an object is said to undergo "planetary motion" when it spins about one axis and orbits about another axis. Such rotary machines, such as those described above, can be designed for various applications including, for example, as pumps, compressors, and expansion engines. The design, configuration and operation of different rotary machines can offer particular advantages for certain applications.

In some end-use applications, it can be important, or at least desirable, for rotary machines to be able to tolerate the presence of solids in the fluid stream being handled by the machine. Solids can cause jamming, abrasive wear of components and/or premature failure of the machine.

SUMMARY OF THE INVENTION

In at least some of a first set of embodiments, a rotary machine comprises a stator and a rotor. The rotor has a rotor helical profile, a rotor axis, and a hypotrochoidal shape at any cross-section transverse to the rotor axis, along at least a portion of a length of the rotor. The rotor is disposed within the stator and is configured to undergo planetary motion relative to the stator. The stator has a stator helical profile, a stator axis, and a shape at any cross-section transverse to the stator axis along at least a portion of a length of the stator that is an outer envelope formed when the hypotrochoidal shape of the rotor undergoes planetary motion. In some of the first set of embodiments the hypotrochoidal shape has n lobes, where n is an integer, the outer envelope shape has (n−1) lobes, the pitch of the rotor is the same as the pitch of the stator; and the ratio of the lead of the rotor to the lead of the stator is n:(n−1). In some such embodiments the hypotrochoidal shape is an ellipse, and n=2.

In at least some of a second set of embodiments, a rotary machine rotary machine comprises a stator and a rotor. The rotor has a helical profile, a rotor axis, and a rotor shape that is inwardly offset from a hypotrochoidal shape at any cross-section transverse to the rotor axis, along at least a portion of a length of the rotor. The rotor is disposed within the stator and is configured to undergo planetary motion relative to the stator. The stator has a stator axis, a helical profile, and a stator shape at any cross-section transverse to the stator axis along at least a portion of a length of the stator that is an outer envelope formed when the rotor shape undergoes planetary motion. In some of the second set of embodiments, the hypotrochoidal shape has n lobes, where n is an integer, the outer envelope shape has (n−1) lobes, the pitch of the rotor is the same as the pitch of the stator; and the ratio of the lead of the rotor to the lead of the stator is n:(n−1). In some such embodiments the hypotrochoidal shape is an ellipse, and n=2.

In at least some of a third set of embodiments, a rotary machine rotary machine comprises a stator and a rotor. The stator has a helical profile, a stator axis, and an epitrochoidal shape at any cross-section transverse to the stator axis, along at least a portion of a length of the stator. The rotor has a helical profile, a rotor axis, and a shape at any cross-section transverse to the rotor axis, along at least a portion of a length of the rotor, that is an inner envelope formed when the epitrochoidal shape of the stator undergoes planetary motion. The rotor is disposed within the stator and is configured to undergo planetary motion relative to the stator. In some of the third set of embodiments, the epitrochoidal shape of the stator has n−1 lobes, where n is an integer, the inner envelope shape of the rotor has n lobes, the pitch of the rotor is the same as the pitch of the stator, and the ratio of the lead of the rotor to the lead of the stator is n:(n−1). In some such embodiments n=2.

In at least some of a fourth set of embodiments, a rotary machine rotary machine comprises a stator and a rotor. The stator has a stator axis, a helical profile, and a stator shape that is outwardly offset from an epitrochoidal shape at any cross-section transverse to the stator axis, along at least a portion of a length of the stator. The rotor has a rotor axis, a helical profile, and a rotor shape at any cross-section transverse to the rotor axis, along at least a portion of a length of the rotor, that is an inner envelope formed when the stator shape undergoes planetary motion. The rotor is disposed within the stator and is configured to undergo planetary motion relative to the stator. In some of the fourth set of embodiments, the stator shape has n−1 lobes, where n is an integer, the rotor shape has n lobes, the pitch of the rotor is the same as the pitch of the stator, and the ratio of the lead of the rotor to the lead of the stator is n:(n−1). In some such embodiments n=2.

In some embodiments of rotary machines, such as the first, second, third and fourth sets of embodiments discussed above, the rotor is configured to spin about the rotor axis, the stator is configured to spin about the stator axis, and the rotor and stator are held at a fixed eccentricity with the rotor axis offset relative to the stator axis, so that during operation of said helical trochoidal rotary machine the rotor undergoes planetary motion relative to said stator without orbiting.

In some embodiments of rotary machines, such as the first, second, third and fourth sets of embodiments discussed above, the rotary machine is a multi-stage machine having a plurality of chambers between (and defined by) a fluid-facing surface of the rotor and a fluid-facing surface of the stator, and the fluid-facing surface of the rotor and/or the fluid-facing surface of the stator comprise one or more solids-handling features. In some embodiments, the rotary machines further comprise at least one seal mounted on the rotor and/or at least one seal mounted on the stator. In some embodiments, each of the plurality of chambers has approximately the same dimensions and shape. In some embodiments at least one of the plurality of chambers has dimensions that are different from another of the plurality of chambers.

In some embodiments, the solids-handling features comprise at least one groove formed in the fluid-facing surface of the rotor and/or in the fluid-facing surface of the stator. In some embodiments, the solids-handling features comprise a plurality of grooves formed in the fluid-facing surface of the rotor and/or in the fluid-facing surface of the stator. In some embodiments, the solids-handling features comprise at least one stitched groove formed in the fluid-facing surface of the rotor and/or in the fluid-facing surface of the stator. In some embodiments, the solids-handling features comprise a plurality of stitched grooves formed in the fluid-facing surface of the rotor and/or in the fluid-facing surface of the stator. In some embodiments, the solids-handling features comprise a plurality of indentations formed in the fluid-facing surface of the rotor and/or in the fluid-facing surface of the stator. In some embodiments, the solids-handling features are disposed asymmetrically on the fluid-facing surface of the rotor and/or on the fluid-facing surface of the stator.

In some embodiments of rotary machines, such as the first, second, third and fourth sets of embodiments discussed above, the rotary machine comprises at least one seal mounted on the rotor and/or the stator wherein each of the at least one seals has at least one of the following characteristics: the seal is mounted asymmetrically on the rotor or the stator; an outer surface of the seal is featured with indentations; an outer surface of the seal is featured with protrusions; the seal is configured to act as a scraper during operation of the rotary machine.

In some embodiments, the rotor has a double-start helical profile having a first rotor thread and a second rotor thread, the stator has a single-start helical profile, and the at least one seal comprises a first helical rotor seal mounted in a first groove extending along a path to one side of the crest of the first rotor thread of the helical rotor, and a second helical rotor seal mounted in a second groove extending along a path to one side of the second thread of the helical rotor. In some embodiments, the rotor has a double-start helical profile, and the stator has a single-start helical profile having a first stator thread, and the at least one seal comprises a helical stator seal mounted in a first groove extending along a path to one side of the first stator thread of the helical stator. In some embodiments, the at least one seal comprises at least one rotor seal mounted on the rotor. In some embodiments, the at least one seal comprises at least one stator seal mounted on the stator. In some embodiments, the at least one seal comprises at least one rotor seal mounted on the rotor and at least one stator seal mounted on the stator. In some embodiments, the rotary machine is a multi-stage machine having a plurality of chambers between (and defined by) cooperating surfaces of the rotor and the stator, and wherein each of the plurality of chambers has approximately the same dimensions and shape. In some embodiments, the rotary machine is a multi-stage machine having a plurality of chambers between (and defined by) cooperating surfaces of the rotor and the stator, and at least one of the plurality of chambers has dimensions that are different from another of the plurality of chambers.

DETAILED DESCRIPTION OF ILLUSTRATIVE EMBODIMENT(S)

Figure 1A:
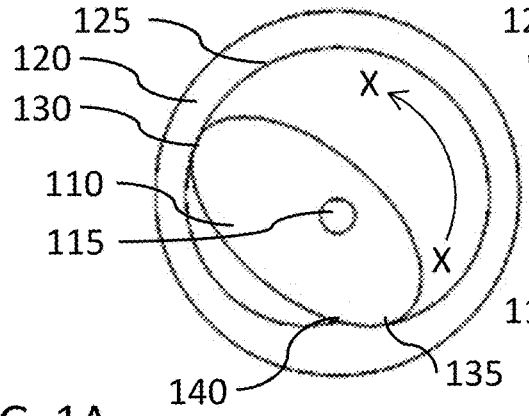
FIGS. 1A-1F (Prior Art) are schematic diagrams illustrating, in transverse cross-section, the geometry of an elliptical rotor and stator assembly at different stages of a single revolution of the elliptical rotor.
Figure 1B:
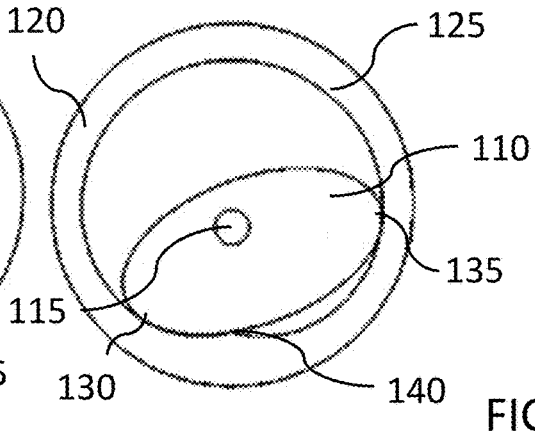
Figure 1C:
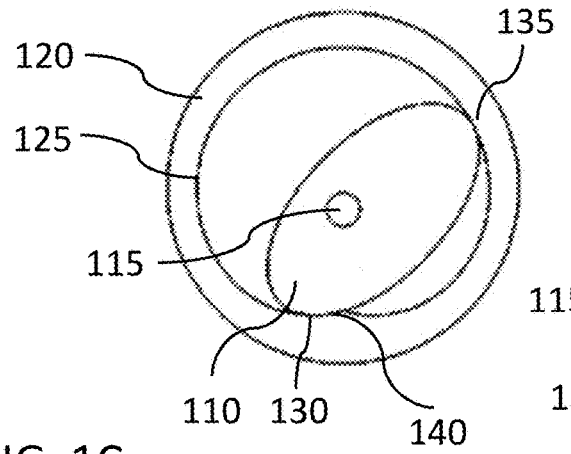
Figure 1D:
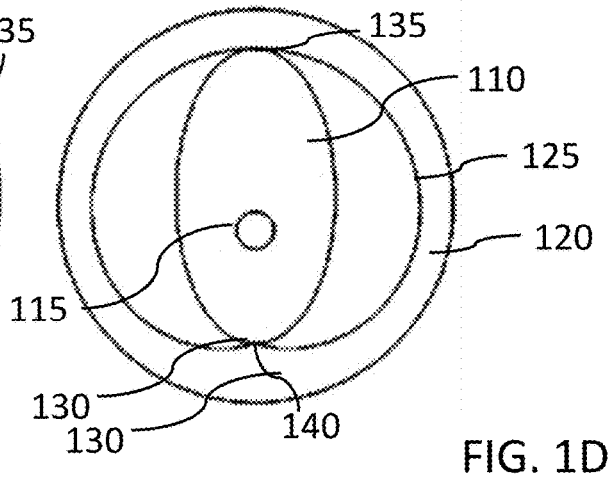
Figure 1E:
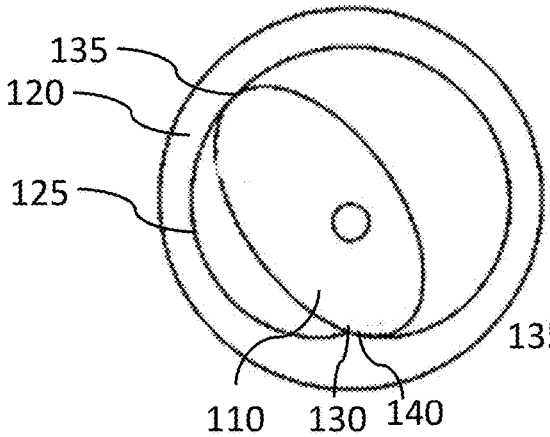
Figure 1F:
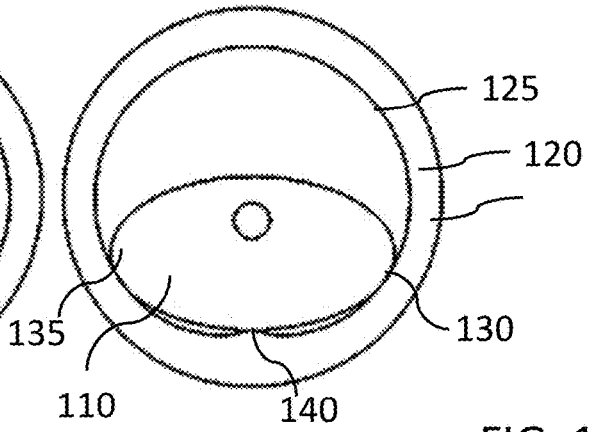
FIG. 1F Prior Art

The present disclosure relates to, among other things, rotary machines in which a helical rotor undergoes planetary motion relative to a stator. As used herein the term "stator" refers to an outer member, within which a rotor can be disposed, and is not limited to a stationary component of a rotary machine. In some embodiments of the rotary machines described herein, the outer member is configured to be stationary during operation of the rotary machine, for example as a fixed stator. In some embodiments of the rotary machines described herein, the outer member is configured to move during operation of the rotary machine. For example, in some embodiments the outer member may spin about its axis or undergo planetary motion about a rotor. The rotary machines described herein are based on trochoidal geometries, with the rotor or stator having a trochoidal geometry (in transverse cross-section, i.e. perpendicular to its axis). In some embodiments, the stator cavity can have an epitrochoidal cross-sectional geometry with the corresponding rotor cross-sectional profile being the inner envelope formed by the trochoid as it undergoes planetary motion (with the rotor having one more apex or lobe than the stator cavity). Much of the description below is focused on embodiments in which the rotor has a hypotrochoidal cross-sectional shape, with the corresponding stator cavity profile being the outer envelope of the rotor as it undergoes planetary motion (with the rotor having one more apex or lobe than the stator cavity). In at least some of these embodiments, one or more specific points on the envelope (whether it be the rotor or the stator) is in continuous contact with the corresponding component, and the contact point traces a trochoidal profile as the components execute their relative motion.

In some embodiments, the hypotrochoid and outer envelope (rotor and stator transverse cross-sectional profiles, respectively) are each swept along helical paths, the axes of those helices being the axes of rotation of those components in a reference frame in which both parts undergo simple rotary motion (the "centers" of those components). In some embodiments, the axes of the rotor and stator helices are offset from one another by a distance equal to the eccentricity of the rotor. In some embodiments, the helical rotor and corresponding stator have the same pitch, and the ratio of the lead of the rotor to the lead of the stator is the same as the ratio of their number of lobes (which is also the same as the ratio of their number of starts). As used herein, "pitch" is defined as the axial distance between adjacent threads (or crests or roots, for example, on a helix), and "lead" is defined as the axial distance or advance for one complete turn (360°). Pitch and lead are equal with single start helices; for multiple start helices the lead is the pitch multiplied by the number of starts.

In some embodiments of the rotary machines, the stator cross-sectional shape has n−1 lobes, where n is an integer greater than 1, the rotor shape has n lobes, the pitch of the rotor is the same as the pitch of the stator, and the ratio of the lead of the rotor to the lead of the stator is n:(n−1). In some embodiments, where n=2, the pitch of the rotor is the same as the pitch of the stator, and the ratio of the lead of the rotor to the lead of the stator is 2:1.

Thus, in some embodiments the outer surface of a helical rotor is defined by an ellipse swept along a helical path, and a corresponding stator cavity is defined by sweeping the corresponding outer envelope along a helical path with half the lead of the helical rotor. The rotor profile is a double-start helix, and the stator profile is a single-start helical cavity. For such a machine, when a transverse cross-section is taken in any plane perpendicular to the axis of rotation (of the rotor and/or stator), the outer profile of the rotor and inner profile of the stator (that is, the cross-sectional shape of the rotor and stator, respectively) is similar to those illustrated for those components in FIGS. 1A-1F in which rotor 110 and stator 120 are shown at different points in time during a single revolution of the rotor within the stator. Stator inner surface 125 comprises an inverse apex 140. A portion of each of rotor tips 130 and 135 is in contact with inner surface 125 of stator 120, and outer surface of rotor 110 is in contact with inverse apex 140. Rotor 110 spins about its longitudinal axis and rotates eccentrically in the direction indicated by arrow X-X (counter-clockwise) about axis 115.

Figure 2A:
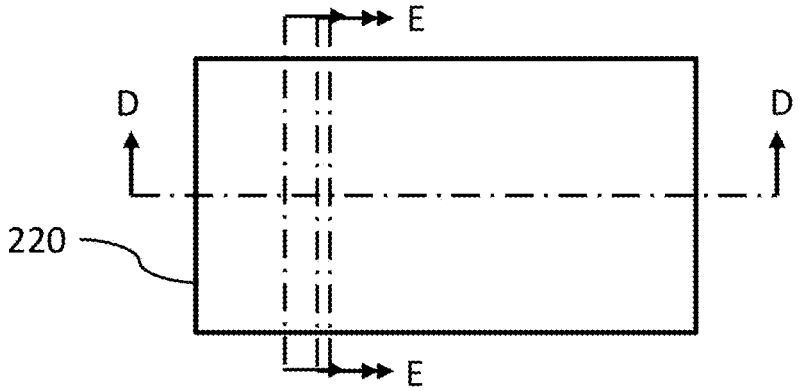
FIG. 2A shows a side view of a rotor-stator assembly showing an outer cylindrical surface of the stator.
Figure 2B:
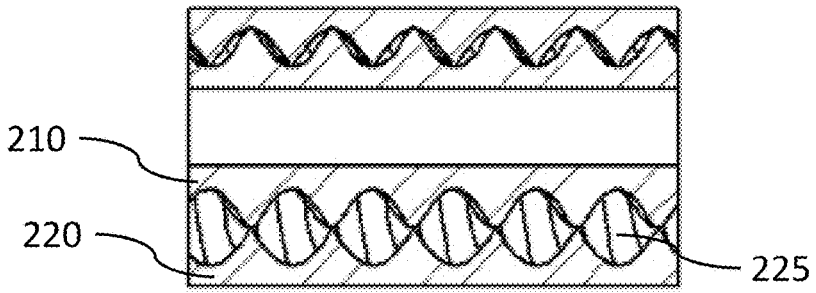
FIG. 2B is a cross-sectional view of the rotor-stator assembly of FIG. 2A, taken in the direction of arrows D-D, showing a helical rotor disposed within a helical stator cavity.
Figure 2C:
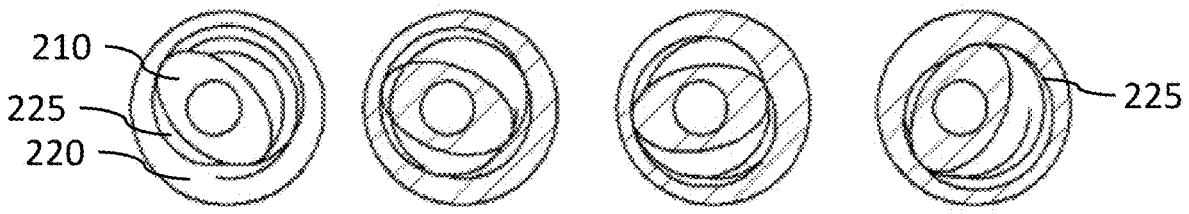
FIG. 2C shows an end view and three cross-sectional views taken in the direction of arrows E-E in FIG. 2A, showing the helical rotor with a two-lobe, elliptical transverse cross-section.

FIGS. 2A-C illustrate another example of such a rotary machine. FIG. 2A shows a side view of a stator 220. The exterior surface of stator 220 is cylindrical. FIG. 2B is a cross-sectional view taken in the direction of arrows D-D in FIG. 2A, and shows helical rotor 210 disposed within a helical stator cavity 225 defined by stator 220. FIG. 2C shows an end view and various cross-sectional views taken in the direction of arrows E-E in FIG. 2A. Rotor 210 has an elliptical transverse cross-section, as shown in FIG. 2C. As the cross-section E-E progresses along the axis of rotation of rotor 210, the cross-sectional profile of the rotor and stator progresses in a manner analogous to the motion over time of rotor 110 within stator 120, as illustrated in FIGS. 1A-1G. In the embodiment illustrated in FIGS. 2A-2C, rotor 210 has two lobes and stator cavity 225 has one lobe.

Figure 3A:
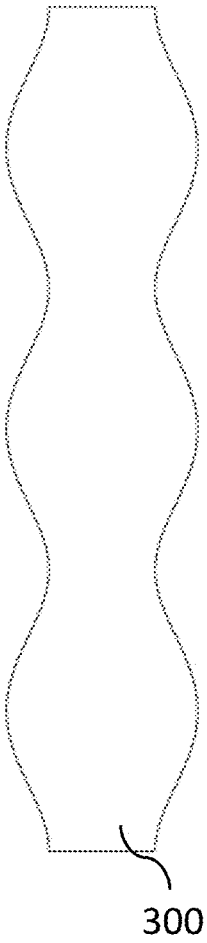
FIG. 3A is a side view of a helical rotor with an elliptical transverse cross-section.
Figure 3B:
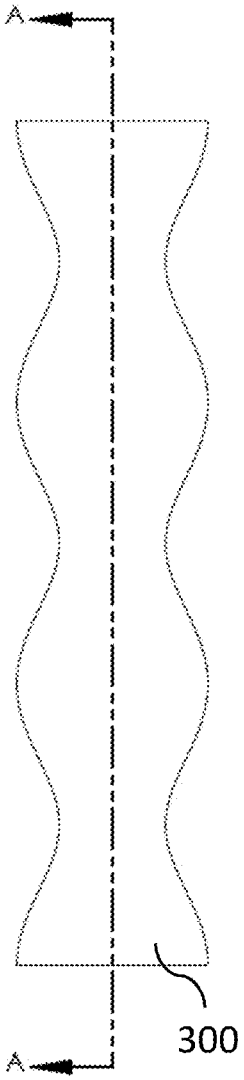
FIG. 3B is another side view of the helical rotor of FIG. 3A, orthogonal to the view of FIG. 3A.
Figure 3C:
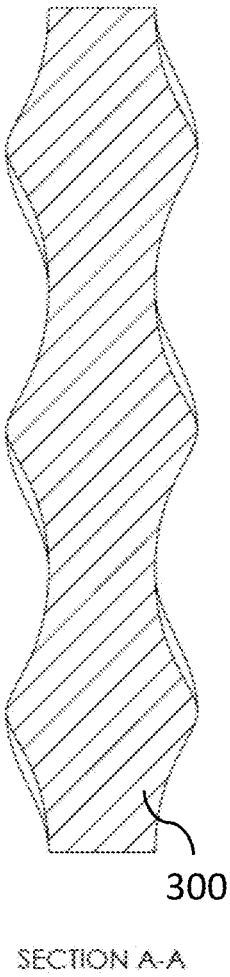
FIG. 3C is a cross-sectional view of the helical rotor of FIG. 3A taken in the direction of arrows A-A in FIG. 3B.

FIG. 3A is a side view of helical rotor 300 (with an elliptical transverse cross-section) similar to rotor 210 of FIGS. 2A-C. FIG. 3B is another side view of helical rotor 300, orthogonal to the view of FIG. 3A. FIG. 3C shows a cross-sectional view of rotor 300 taken in the direction of arrows A-A in FIG. 3B.

Figure 4A:
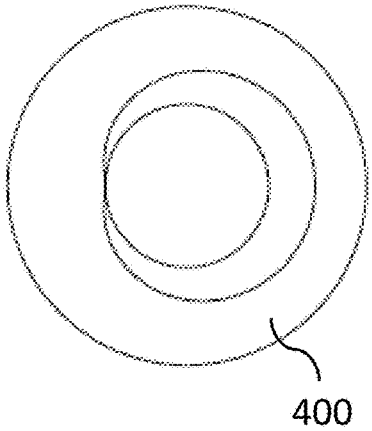
FIG. 4A is an end view of a stator with a helical cavity.
Figure 4B:
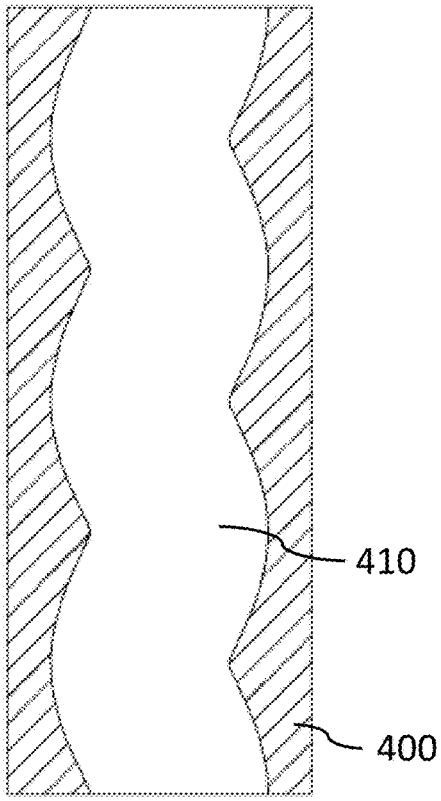
FIG. 4B is a transverse cross-sectional view of the stator of FIG. 4A.
Figure 4C:
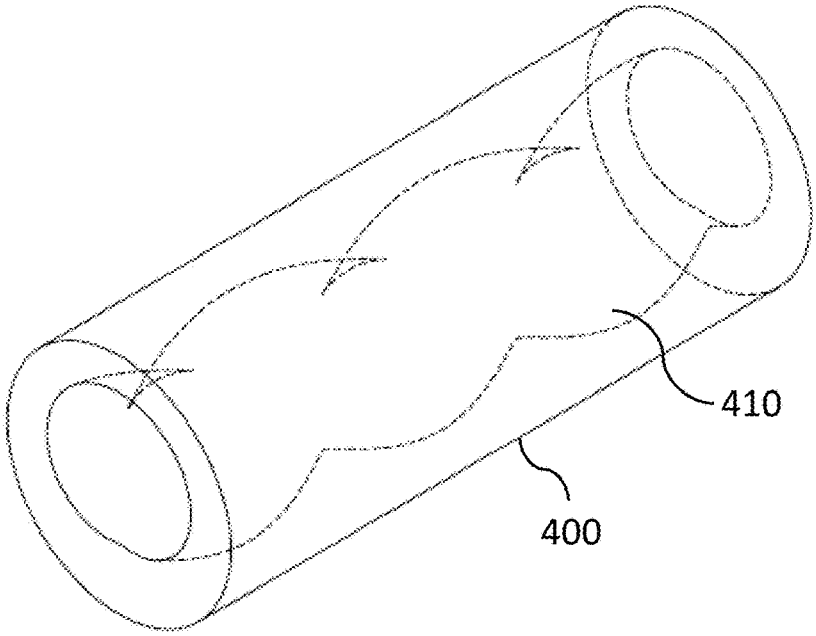
FIG. 4C is an isometric view of the stator of FIG. 4A (with the dashed line indicating the stator cavity).

FIG. 4A is an end view, FIG. 4B is a cross-sectional view and FIG. 4C is an isometric view of stator 400 having helical stator cavity 410 (with the dashed line in FIG. 4C indicating helical stator cavity 410). Stator 400 corresponds to rotor 300 of FIGS. 3A-C (in other words stator 400 can be used with rotor 300), and is similar to stator 220 of FIGS. 2A-C.

Figure 5:
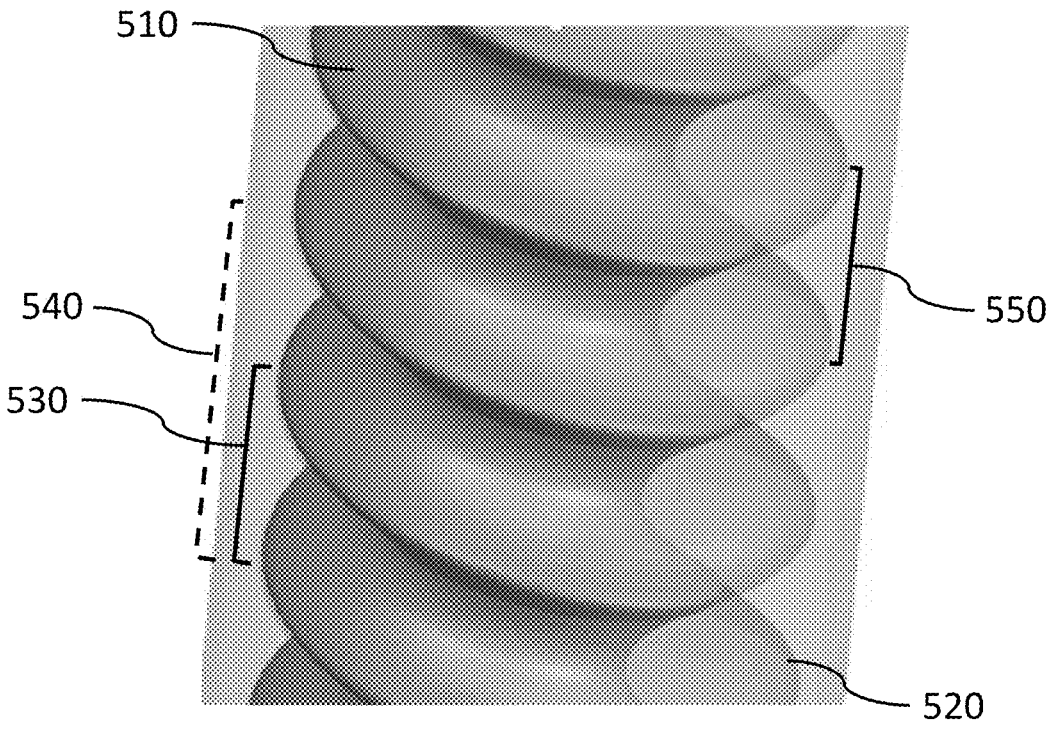
FIG. 5 illustrates a portion of a rotor-stator assembly, showing a helical rotor disposed inside a translucent helical stator.

FIG. 5 illustrates an example of a portion of a machine such as illustrated in FIGS. 2A-2C, showing helical rotor 510 disposed inside translucent helical stator 520. The pitch of the rotor (distance between adjacent threads or crests) is indicated by distance 530, and the lead of the rotor is indicated by distance 540. Because the rotor is a double-start helix, the lead is twice the pitch. The pitch of the stator is indicated by distance 550 and, because the stator is a single-start helix, distance 550 is also the lead of the stator. In the embodiment illustrated in FIG. 5, the pitch of the rotor (distance 530) and the pitch of the stator (distance 550) are the same.

In at least some embodiments, there is a quasi-helical contact path between the rotor and the inner "ridge" (or crest) of the stator at all times during rotation of the rotor relative to the stator. The contact path with the stator moves or oscillates back and forth across the helical "ridge" or crest of the rotor as the rotor rotates relative to the stator. The rotor-stator contact path revolves around the machine as pumping action proceeds, "threading" the fluid (or material to be pumped) in a spiral path along the helix, to that it is moved axially from one end of the stator cavity to the other.

The working principal of the rotary machines described herein is independent of which component of the machine is "fixed" and which is rotating. In some embodiments, for example, the machine can be operated such that the stator is fixed and the rotor spins and undergoes planetary motion (orbits) within it. This configuration is mechanically simple and compact, but sometimes requires counterweights to provide balance. In other embodiments, the outer stator undergoes planetary motion about the inner rotor.

Some embodiments of the rotary machines are operated such that the rotor spins but does not orbit. For example, in some embodiments the rotor spins but can be held at a specific eccentricity relative to the stator, and the stator can also be allowed to spin, so that the rotor and stator each revolve around their respective longitudinal axes. In such embodiments, even though the rotor and stator are each spinning (i.e. rotating) about their respective longitudinal axes, the relative motion of the components is basically the same as in corresponding fixed stator embodiments where the rotor spins and orbits within the stator.

In at least some embodiments, holding the rotor and stator at a fixed eccentricity and having these components spin about their longitudinal axes, rather than having one of them orbit, can significantly reduce problems with vibration and make the machine more balanced in operation.

With such rotary machine designs, one approach is to drive the rotor, for example by coupling it to a motor via a drive shaft, and allowing the rotation of the rotor to drive rotation of the stator. In other embodiments, the stator could be driven instead of the rotor. In another approach, the eccentricity is still fixed, but instead of the rotor driving the stator (or vice versa), a gear set is used, and both the rotor and the stator are driven via gears.

Figure 6:
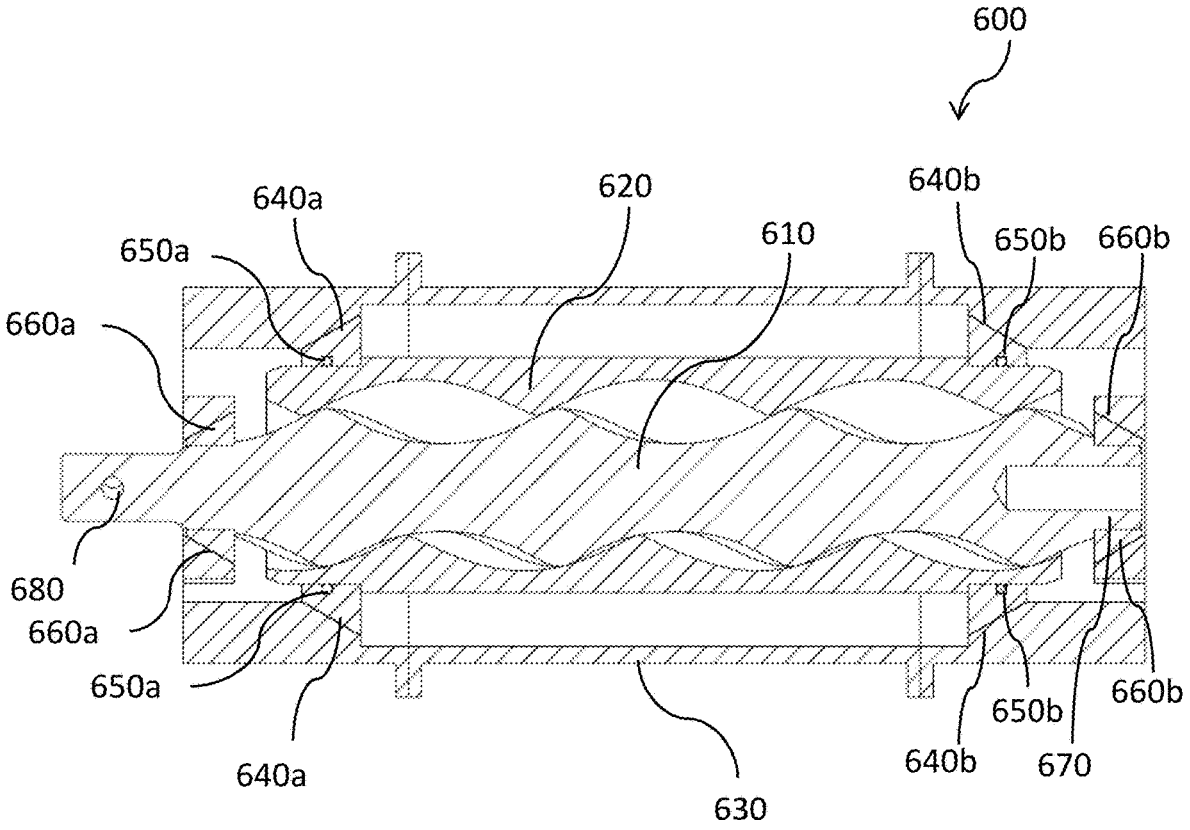
FIG. 6 is a cross sectional view of an embodiment of a fixed-eccentricity rotary machine assembly with a helical rotor with a two-lobe, elliptical transverse cross-section, a stator, a carrier, and tapered journal bearings, where the rotor is configured to drive the stator.

FIG. 6 is a cross-sectional view of an embodiment of a fixed-eccentricity rotary machine assembly 600. Fixed-eccentricity rotary machine assembly 600 can comprise helical rotor 610 having a two-lobe, elliptical transverse cross-section, stator 620 and carrier 630. In some embodiments, such as the one illustrated in FIG. 6, stator 620 is constrained concentrically within carrier 630 and is supported by stator-carrier bearing 640*a* and stator-carrier bearing 640*b* so that it can spin about its axis within carrier 630 but is constrained axially and radially. In this embodiment, stator-carrier bearing 640*a* and 640*b* are tapered journal bearings fitted with annular stator-carrier seal 650*a* and annular stator-carrier seal 650*b*, respectively, to mitigate/reduce or prevent fluid leakage around the rotor-stator assembly. In some embodiments, such as the one illustrated in FIG. 6, rotor 610 is constrained within stator 620 at a position offset from the axis of stator 620 and carrier 630 by a distance equal to the eccentricity. Rotor 610 can be supported by rotor-carrier bearing 660*a* and rotor-carrier bearing 660*b* (which, in FIG. 6 are shown as tapered journal bearings) and anchor pin 670 so that it can spin about its axis within stator 620. In some embodiment, rotor 610 can be coupled to a drive shaft via coupling 680 and driven by a motor, so that it spins about its axis, and drives stator 620 to spin at twice the rate of spin of rotor 610. Thrust bearings, or other suitable bearings can be used instead of tapered journal bearings.

For downhole pump or artificial lift applications, a carrier (such as carrier 630 in FIG. 6) can be fixed rigidly to production tubing (e.g. directly or via larger diameter orbit tubing) which can extend to the surface and accommodate a drive-string as well as carrying the pumped fluid. In at least some embodiments, the carrier can have openings or passages to allow the pumped fluids to pass into the carrier and enter the pump intake.

For downhole pump or artificial lift applications of rotary machines in which the stator is fixed and rotor is configured to spin and orbit within the stator, a drive-string is typically coupled to the rotor and drives the rotor to spin and orbit. For machines where the rotor has a helical profile and an elliptical shape (n=2), the rotor orbits at a radius equal to the eccentricity and it orbits twice as fast as it spins. Thus, with a fixed stator the drive-string also orbits at the same frequency and radius as the rotor. When the eccentricity is fixed and the rotor and stator each spin about their longitudinal axes, a drive-string used to drive the rotor (or stator) to spin would not need to orbit. This simplifies the drive-string design and operation, and can reduce the failures due to vibration in this region of the overall pump system.

Figure 7:
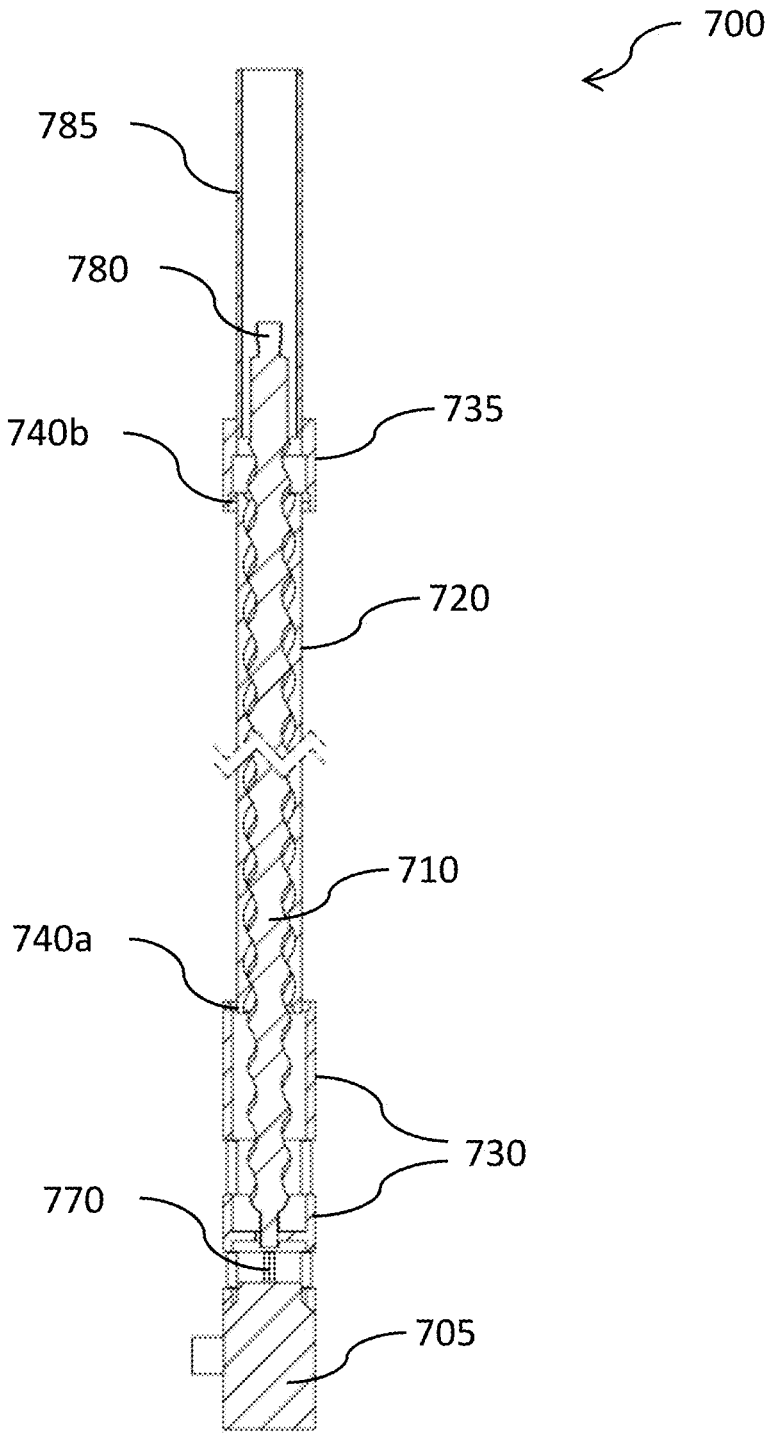
FIG. 7 is a cross-sectional view of an embodiment of a top-driven, fixed-eccentricity downhole pump assembly with a two-lobe helical rotor with elliptical transverse cross-section, a stator, and a carrier, where the rotor is configured to drive the stator.

FIG. 7 shows an embodiment of top-driven downhole pump assembly 700 which can, for example, be inserted into a well. In some embodiments, such as the one illustrated in FIG. 7, torque anchor 705 is at the base of downhole pump assembly 700 and is attached to the well-casing (not shown in FIG. 7), which can be a large diameter pipe that forms the walls of the well. In some embodiments, lower carrier 730 is mounted to torque anchor 705 and supports stator 720 (co-axially) via stator-carrier bearings 740*a* so that it can spin about its axis, but is constrained axially and radially. In some embodiments, helical rotor 710 has a two-lobe, elliptical transverse cross-section and extends through stator 720. The axis of rotor 710 can be offset at a fixed distance (eccentricity) from the axis of stator 720. Rotor 710 is supported via anchor pin 770 and bearings (not shown in FIG. 7), so that it can spin about its axis within stator 720. In some embodiments, rotor 710 can be coupled to a drive shaft via coupling 780 and driven by a motor, so that it spins about its axis, and drives stator 720 to spin at twice the rate of spin of rotor 710. In some embodiments, stator 720 is also mounted to and constrained by upper carrier 735 via stator-carrier bearings 740*b*. Upper carrier 735 can be attached to orbit tube 785 (which in turn connects to production tubing) and/or it can be attached to lower carrier 730.

For downhole pump, artificial lift and similar applications, there are a number of ways a system incorporating pumps of the type described herein could be deployed. For example, the pump can be top-driven where the motor is at the surface and is coupled to the rotor (or stator or gear system) via a drive-string (for example, as shown in FIG. 7). In at least some embodiments, top-driven systems are limited to fairly low rotational speeds, not only due to the centrifugal forces from the rotor, but also due to the rotational speeds of the drive-string. In some embodiments, the pump can be used with a direct-drive system, similar to an electric submersible pump (ESP), where the motor is below the surface (e.g. underground). In at least some embodiments, such direct-drive ESP systems are able to achieve higher rotational speeds.

In some embodiments of the rotary machines the rotor and/or the stator are plastic. In some embodiments, the rotor and/or the stator can be metal. In some embodiments, depending on the application, the rotor and/or stator can be made from ceramic, elastomeric or other suitable materials or combinations of materials. The material(s) of the rotor can be the same as, or different from, the material(s) of the stator.

Figure 8A:
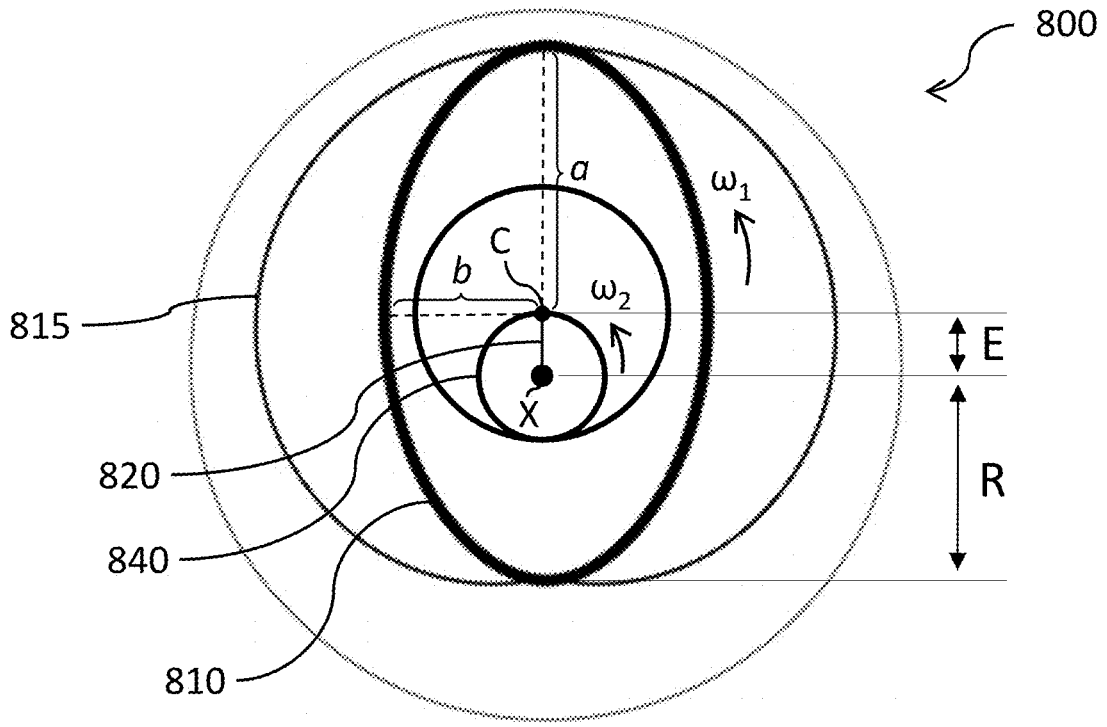
FIG. 8A is a diagram illustrating geometry that can represent an embodiment of a helical rotor-stator assembly in transverse cross-section.

FIG. 8A is a diagram illustrating the geometry of an ellipse rotating about the head of a rotating radial arm. Geometric configuration 800 can represent a helical rotor-stator assembly in transverse cross-section. FIG. 8A can be helpful in understanding the geometry of some embodiments of the rotary machines. In geometric configuration 800, ellipse 810 has center C. Ellipse 810 rotates about center C at angular velocity $\omega_1$ in a counter-clockwise direction relative to a frame of reference in which center C is stationary (just as a helical rotor may spin about its axis).

Ellipse 810 also rotates eccentrically within stator cavity 815, as if it is attached at its centre C to the head of radial arm 820 that rotates about a fixed end X. Circle 840 is the locus of the head of radial arm 820 as it rotates about fixed end X. Ellipse 810 rotates eccentrically at angular velocity $\omega_2$ in a counter-clockwise direction relative to a frame of reference in which fixed end X is stationary. The eccentricity, E, is the distance between centre C of ellipse 810 and X. Eccentricity E can be defined as the distance between the axis of rotation and the axis of symmetry. Radius R is the length "a" of the semi-major axis of ellipse 810 minus eccentricity E. Radius R is also equivalent to the average of the major and minor radii of the ellipse, i.e. (a+b)/2.

In some embodiments of rotary machines, the inverse apex (or ridge or crest) of the corresponding helical stator is always in contact with the outer surface of helical elliptical rotor during a complete revolution of elliptical rotor. This can be achieved by configuring geometric configuration 800 such that the difference between the semi-major axis of the rotor with elliptical cross-section (shown in FIG. 8A as length "a") and the semi-minor axis of the rotor (shown in FIG. 8A as length "b") is twice the eccentricity E. In other words, in some embodiments:

$$a-b=2E$$

In other words, in such embodiments: a=(R+E) and b=(R−E).

Figure 8B:
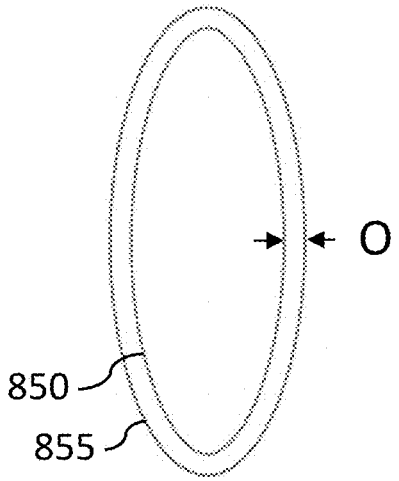
FIG. 8B is a diagram showing an embodiment of a rotor cross-sectional profile inwardly offset from an ellipse.
Figure 8C:
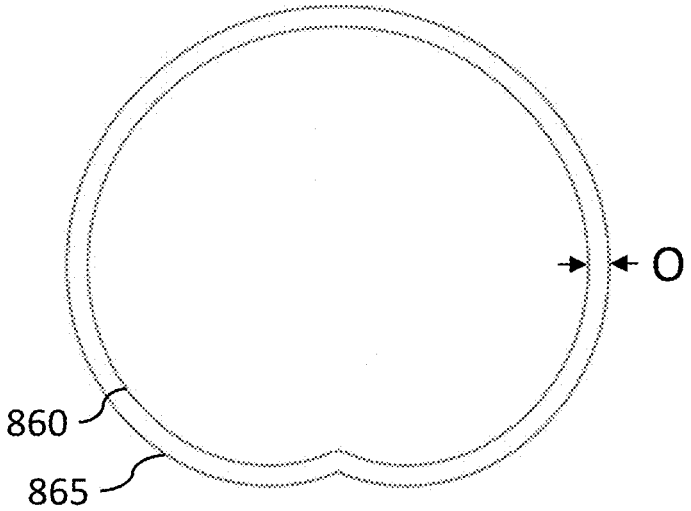
FIG. 8C is a diagram showing an inwardly offset stator cross-sectional profile corresponding to the rotor cross-sectional profile of FIG. 8B.

In variations of some of the helical trochoidal rotary machines described herein, the rotor and stator profiles can be offset along the normals of their planar transverse cross-sections. For example, in some such embodiments where the rotor is hypotrochoidal and undergoes planetary motion relative to a stator that is shaped as an outer envelope of that rotor, the rotor and stator can have cross-sectional profiles that are inwardly offset. For example, FIG. 8B shows rotor cross-sectional profile 850 that is inwardly offset from elliptical shape 855, by offset distance O. FIG. 8C shows a cross-sectional profile 860 of a corresponding stator cavity that is offset from outer envelope 865 of an elliptical rotor by an offset distance O. In some embodiments where the stator is epitrochoidal, and the rotor undergoes planetary motion relative to the stator and is shaped as the inner envelope of that stator, the rotor and stator can have cross-sectional profiles that are outwardly offset. Such variations in geometry can offer additional advantages, as discussed further in issued U.S. Pat. No. 10,837,444, which is incorporated by reference herein.

In multi-stage embodiments of helical trochoidal rotary machines, if the rotor and stator pitch and all dimensions (including a, b and E, R and O as shown in FIGS. 8A-C) remain constant, or at least essentially constant, along the length of the rotor-stator assembly, then the volume and dimensions of the fluid chambers formed between the helical rotor and the stator will be the same along the length of the assembly. Such rotary machines can be used, for example, as pumps and, if driven at constant speed, can provide a substantially steady volumetric flow rate or output.

Figure 9:
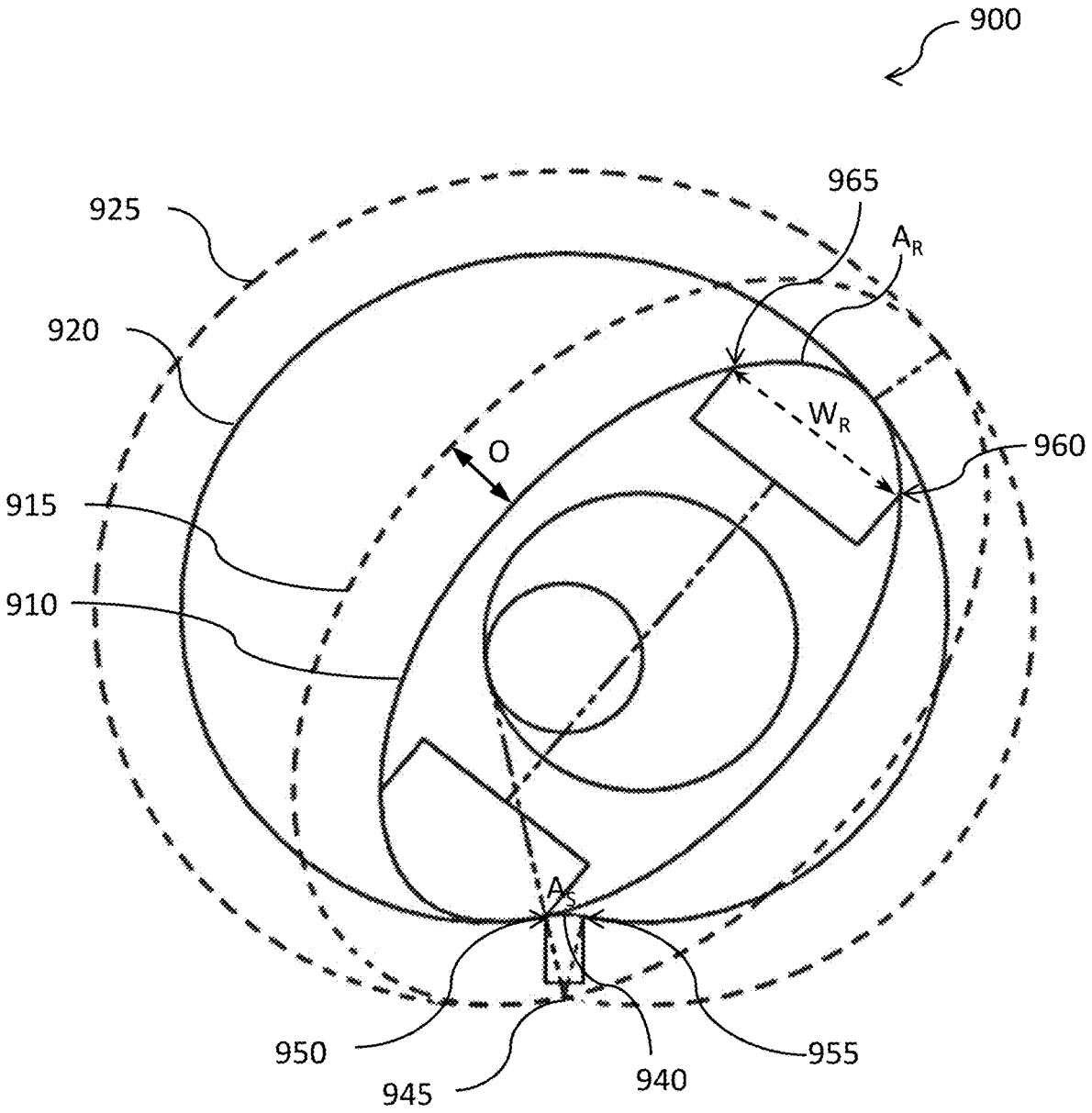
FIG. 9 is a transverse cross-sectional diagram illustrating geometry that can represent an embodiment of a rotor-stator assembly with offset geometry.

FIG. 9 is a transverse cross-sectional diagram of rotor-stator assembly 900, in which a rotor has cross-sectional profile 910 that is inwardly offset from each point on ellipse 915 by a fixed offset distance "O" measured perpendicular to a tangent to ellipse 915 at that point. The resulting rotor cross-sectional profile 910 is not a true ellipse. The corresponding stator cavity profile 920 can be defined as the outer envelope generated when rotor cross-sectional profile 910 undergoes planetary motion, or defined as the correspondingly inward offset of envelope 925 generated by the non-offset hypotrochoid (ellipse 915).

Referring again to FIG. 9, with this "offset" geometry, the inverse apex region 940 of stator is rounded with a circular arc, centered on inverse apex 945 of the "non-offset" geometry. In the plane of the diagram, the contact between inverse apex region 940 of the stator and the rotor tips is continuous, but moves back and forth along the circular arc of the inverse apex region on the stator between points 950 and 955.

The distance between these points along the circular arc is the stator arc length ($A_S$), and the shortest distance between these two points is the sweep width of the inverse apex region. On the rotor, contact with the inverse apex region 940 of the stator occurs between points 960 and 965. The distance between points 960 and 965 around the rotor crest is the rotor arc length ($A_R$), and the shortest distance between these two points is the sweep width ($W_R$) of the rotor.

For a helical rotor-stator assembly, contact between the rotor and stator occurs along curves that are the locus of contact points between the rotor and stator in each transverse "cross section". For non-offset trochoid generating points in the envelope (i.e. the stator "inverse apex" of a hypotrochoid with outer envelope, or the "rotor tips" of an epitrochoid with inner envelope), this locus is a true helix. For offset trochoid generating points, the contact point moves across the arc length of the stator or rotor. This contact curve deviates from the true helix, but is visually substantially similar. The locus of contact points between trochoid and envelope is more complex; in most embodiments, it sweeps across a substantially longer arc, so the contact path is a distorted helix. It is then "interrupted" as the contact point crosses the trochoid generating point. The resulting contact curves are discrete segments, roughly helical in appearance, but not true helices. These have a different slope than the continuous curve of the trochoid generating contact, and "bridge" points on that contact to form closed chambers.

As can be seen, in embodiments such as the one illustrated in FIG. 9, an offset rotor has sharper features than a non-offset rotor, whereas an offset stator has a more rounded inverse apex region than a non-offset stator. For both the offset and non-offset components, the helicization makes the features sharper than they would be in a straight (non-helicized version) of the rotor-stator assembly. Because the lead of the stator is shorter than that of the rotor (by half in the case of a 2:1 rotor-lobe:stator-lobe rotary machine) the "sharpening" of the stator features upon helicization is more dramatic than for the corresponding rotor.

The degree of offset can be selected to give desirable relative rotor and stator profiles. In particular, the degree of offset can be selected to achieve particular design objectives that can be advantageous both physically and also in relation to operation of the rotary machine.

A helical trochoidal pump can be characterized by three geometric factors: radius (R), eccentricity (E), and offset (O). In general terms, the radius and offset dictate the size of the pump, and the eccentricity dictates the cross-sectional shape (e.g. amount of elongation) of the elliptical (or offset elliptical) rotor. Another factor or parameter that can be used to characterize the machine geometry is the eccentricity ratio, as defined in equation (1). The effect of modifying these geometric factors is analyzed further below.

$$\text{Eccentricity ratio} = \frac{E}{R - O} \tag{1}$$

Figure 10A:
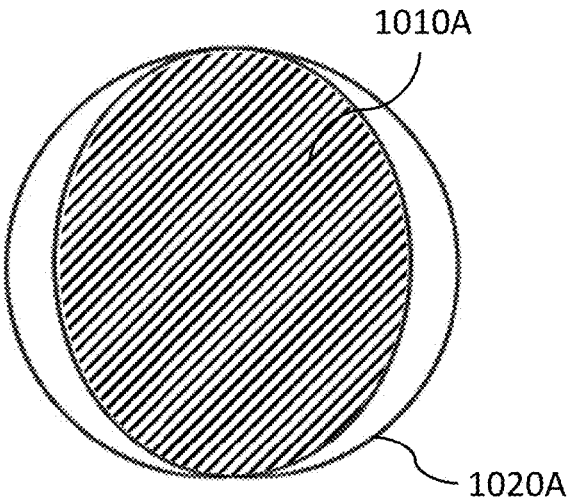
FIG. 10A is a simplified cross-sectional diagram showing the rotor and stator for a helical trochoidal rotary machine with an eccentricity ratio of 0.1.
Figure 10B:
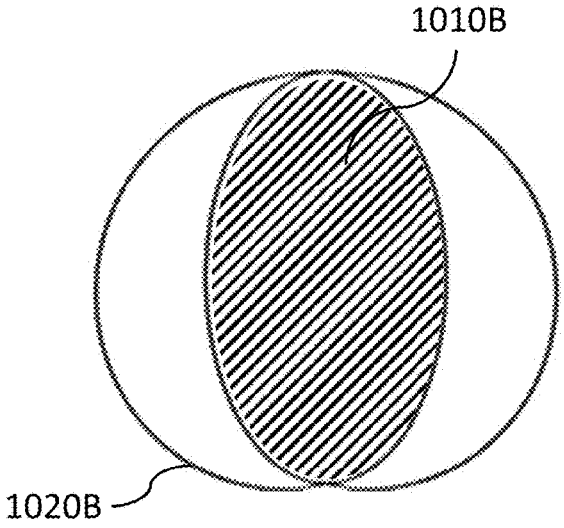
FIG. 10B is a simplified cross-sectional diagram showing the rotor and stator for a helical trochoidal rotary machine with an eccentricity ratio of 0.27.
Figure 10C:
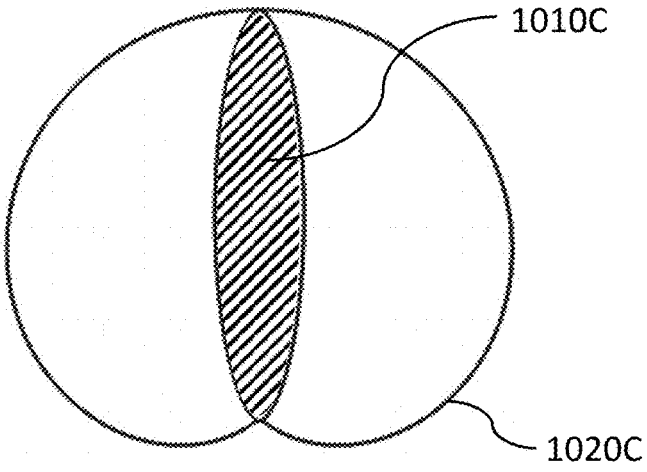
FIG. 10C is a simplified cross-sectional diagram showing the rotor and stator for a helical trochoidal rotary machine with an eccentricity ratio of 0.65.

FIG. 10A is a cross-sectional view of an embodiment of a helical trochoidal pump with an eccentricity ratio of 0.1, showing rotor 1010A in stator cavity 1020A. FIG. 10B is a cross-sectional view of an embodiment of a helical trochoidal pump with an eccentricity ratio of 0.27, showing rotor 1010B in stator cavity 1020B. FIG. 10C is a cross-sectional view of an embodiment of a helical trochoidal pump with an eccentricity ratio of 0.65, showing rotor 1010C in stator cavity 1020C. FIGS. 10A-C illustrate how the cross-sectional profile of the rotor changes with eccentricity ratio.

Figure 11:
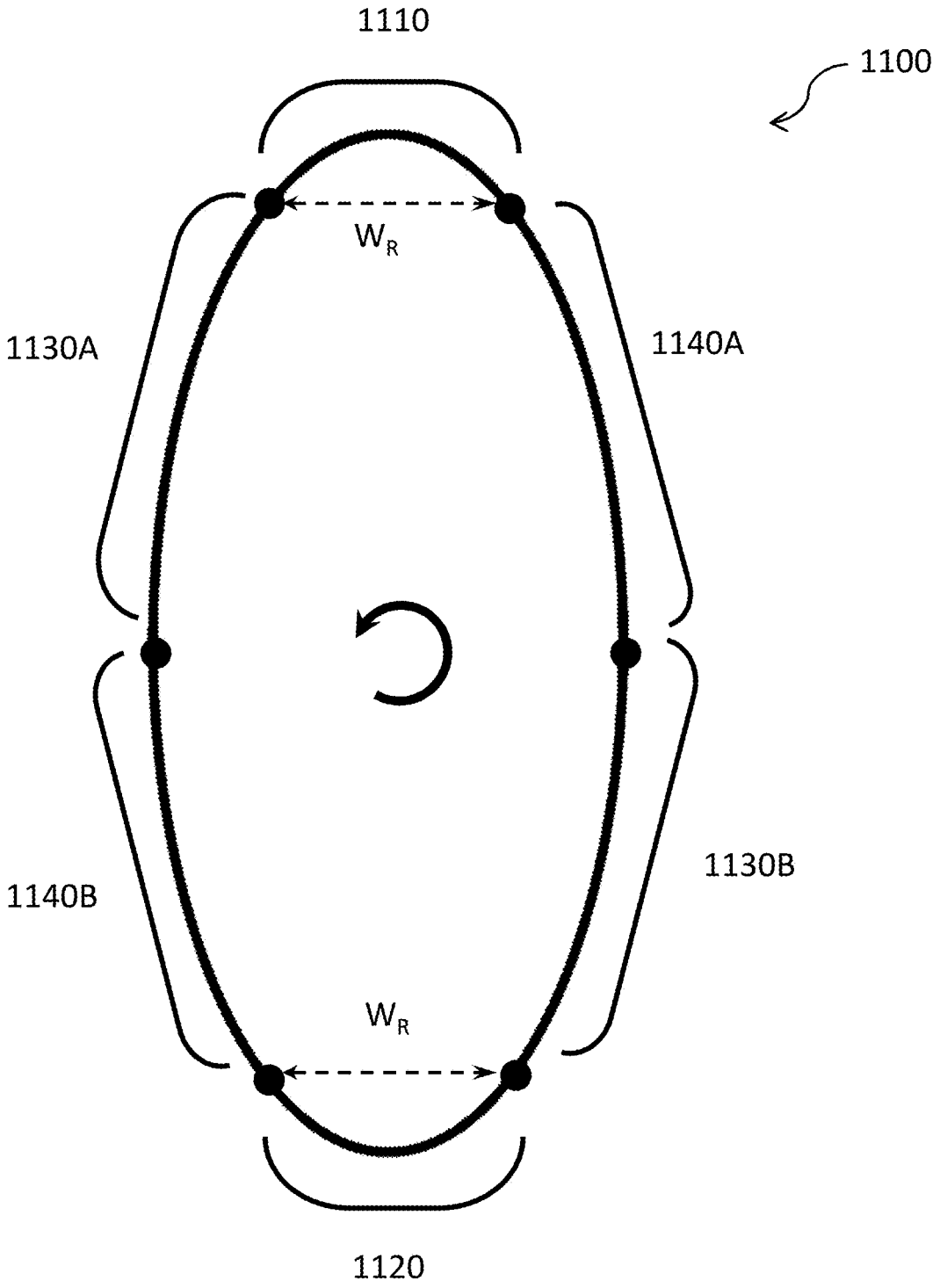
FIG. 11 shows a helical rotor in transverse cross-section.

FIG. 11 shows rotor 1100 in transverse cross-section and illustrates how these terms are used herein. Rotor tips (or crests) are regions 1110 and 1120 which have a continuous swept contact with the adjacent stator profile during rotation of the rotor relative to the stator. The flanks are the regions on each quadrant of the helical rotor between the tips (or crests) and the root of the threaded rotor. Leading flanks of rotor 1100 are shown as 1130*a* and 1130*b*, and trailing flanks are shown as 1140*a* and 1140*b*, when the rotor is rotating relative to the stator as indicated by the arrow. Similarly, the threaded stator has flank regions, which can be leading or trailing, as well as the helical inverse apex region which forms the crest of the internal thread of the stator.

Solids handling capability relates to the capability of a rotary positive displacement machine, such as a pump, to be able transport fluids containing solids (e.g. hard particulates such as sand, fines, small rocks etc.) with a reduced tendency for jamming of the machine and/or with a reduced tendency for wear on one or more of the components of the machine. Various approaches can be used to improve the solids handling capability of the helical trochoidal rotary machines described herein.

Solids-Handling Features on Rotors and Stators

One approach that can be used to improve the solids handling capability of the above-described rotary machines is to incorporate features on the fluid-facing surfaces of the rotor and/or stator that can accommodate, trap and/or transport solids. In some embodiments, the solids-handling features are indentations in the rotor or stator surface. Functionally, in some pump embodiments and end-use applications thereof, such features can act as a temporary trap for solids. The features can provide a place for solids to go, so they are not caught or squeezed between the contact surfaces when the stator slides by the rotor as a liquid containing the solids is pumped. The solids can exit the features and be entrained once again in the liquid as it moves along the fluid chambers created between the rotor and stator. In some embodiments and end-use applications, solids-handling features also cause additional turbulence in the flow of the fluid being pumped, and this can facilitate clearing of solids from the features so that they are entrained in the fluid as the fluid moves along the chambers and are discharged from the pump (along with the fluid) at the outlet. For example, using a grooved or "rifled" helical rotor or stator in helical trochoidal rotary pumps can allow solids to be accommodated in these grooves during operation of the pump, instead of being forced between the rotor and stator surfaces where they may cause wear of pump components and/or cause the machine to jam.

There is an array of options for solids-handling features that can be incorporated into a helical trochoidal rotary machine. For example, for various embodiments of helical trochoidal rotary machines with solids-handling features, selections can be made from each of the following categories:

- The component on which the features are incorporated. For example, on the rotor and/or the stator.
- The number of features. For example, a single groove or multiple grooves.
- The nature of the features. For example, continuous grooves, "stitched" grooves, circular or elongated pockets, indentations, or pits, and/or cross-hatched patterns.
- The cross-sectional profile of the features. For example, semi-circular, rectangular, triangular (V-shaped), or U-shaped.
- The dimensions of the features. For example, relative to the dimensions of the rotor and stator, and/or relative to other features, and/or depending on the type and dimensions of the solid particles that are likely to be in the fluid being transported by the pump.
- The path on which the features are positioned and their orientation. For example, grooves on the rotor following rotor pitch or following the stator apex path, or grooves on the stator following the stator pitch or the rotor tip path, or adjusted versions of any of these.
- The location of the features relative to the cross-sectional profile of the rotor or stator. For example, around the full profile of the rotor or stator, on the leading or trailing quadrants of the rotor (e.g. only on diagonally opposite quadrants) or on the leading or trailing side of the stator inverse apex, in the rotor tip region, in the rotor flank region etc.

Some examples of helical rotors and stators incorporating solids-handling features are described in reference to FIGS. 12-23 below.

Figure 12A:
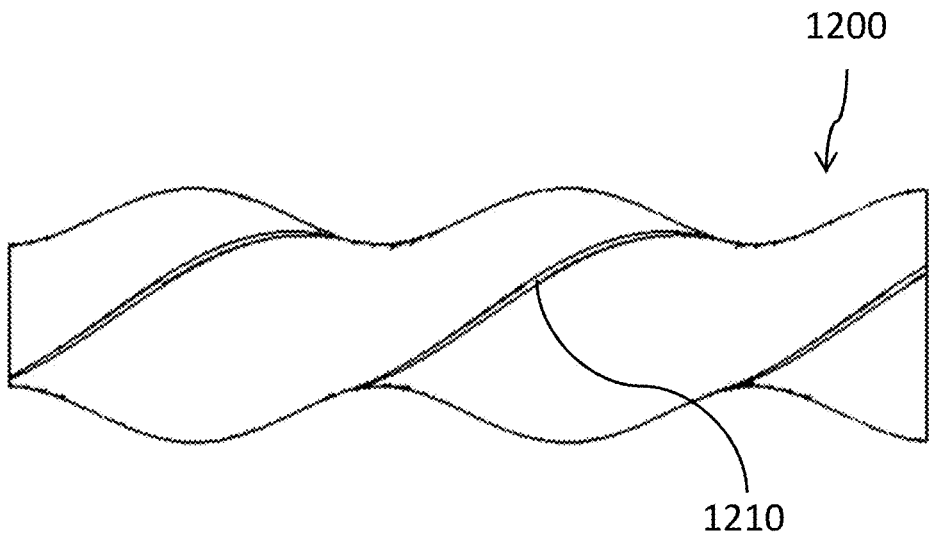
FIG. 12A is a side view of a helical rotor with a solids-handling groove formed in the rotor surface.
Figure 12B:
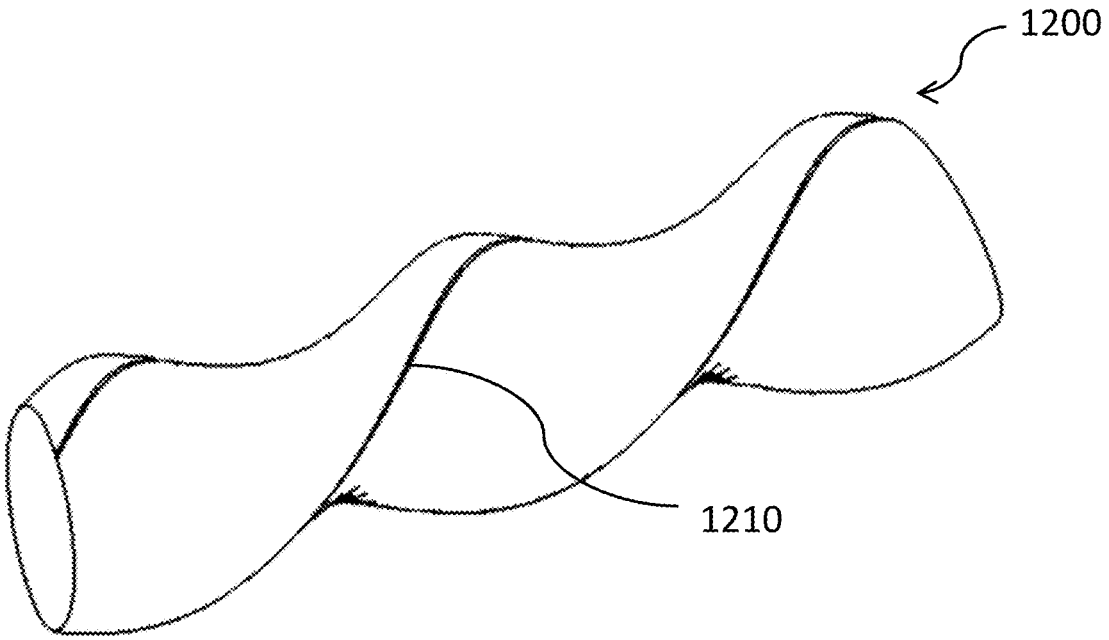
FIG. 12B is an isometric view of a helical rotor with a solids-handling groove formed in the rotor surface.

FIGS. 12A and 12B show helical rotor 1200 with a single solids-handling groove 1210 formed in the rotor surface, winding around rotor 1200.

Figure 13A:
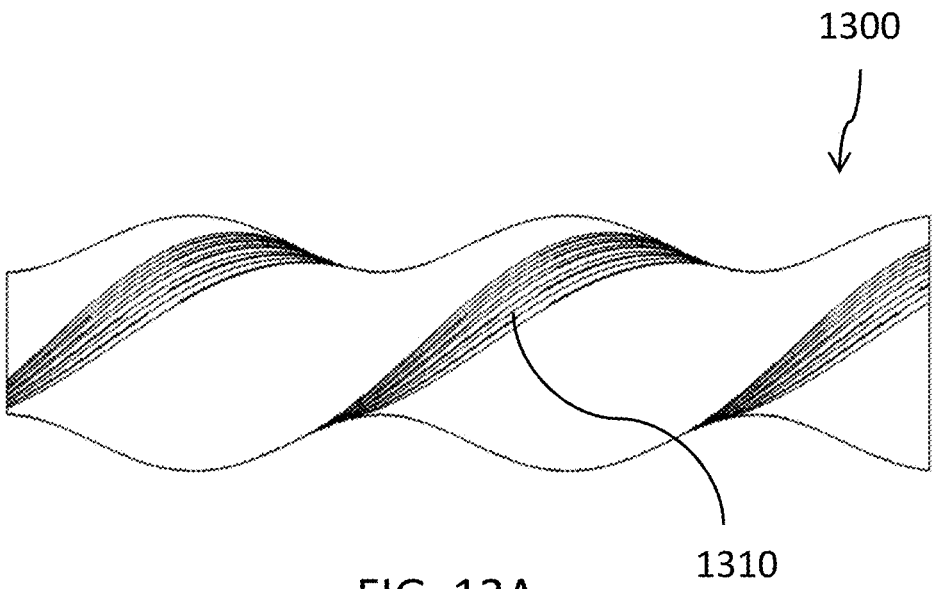
FIG. 13A is a side view of a helical rotor with five parallel solids-handling grooves formed in the rotor surface.
Figure 13B:
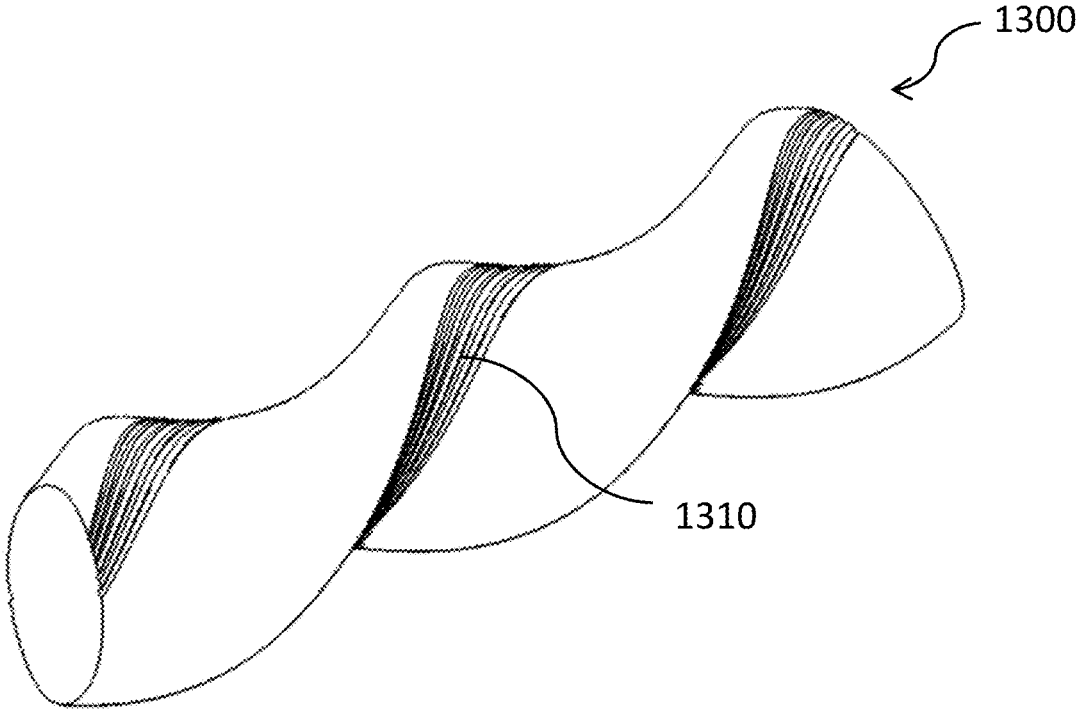
FIG. 13B is an isometric view of a helical rotor with five parallel solids-handling grooves formed in the rotor surface.

FIGS. 13A and 13B show helical rotor 1300 with five parallel solids-handling grooves 1310 formed in the rotor surface, winding around rotor 1300.

Figure 14A:
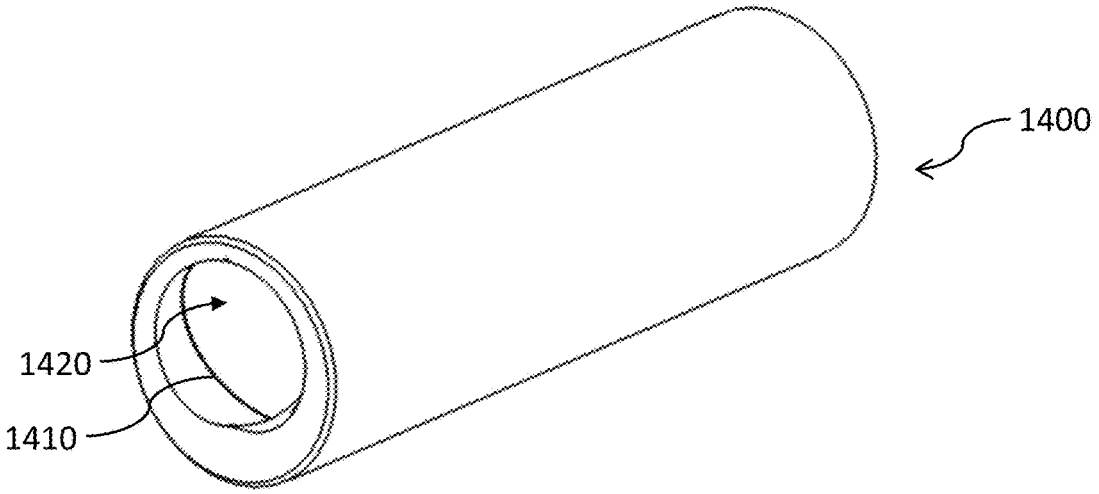
FIG. 14A is an isometric view of a rifled stator with a helical cavity and a single solids-handling groove formed in the inner surface of the stator.
Figure 14B:
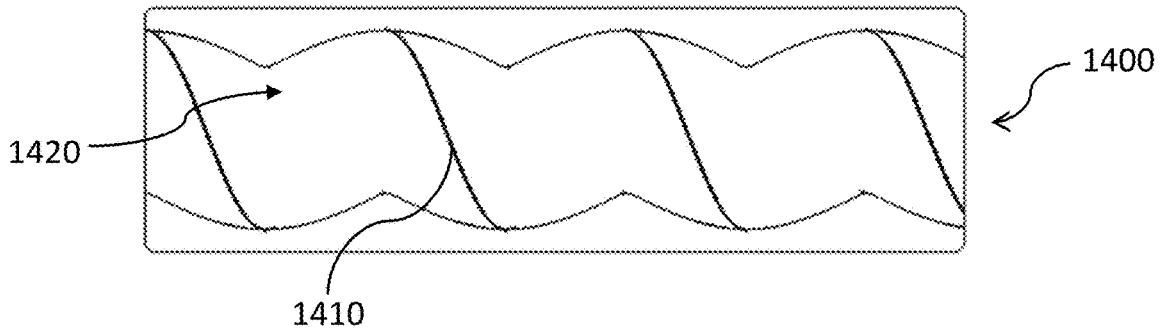
FIG. 14B is a side cross-sectional view of a rifled stator with a helical cavity and a single solids-handling groove formed in the inner surface of the stator
Figure 14C:
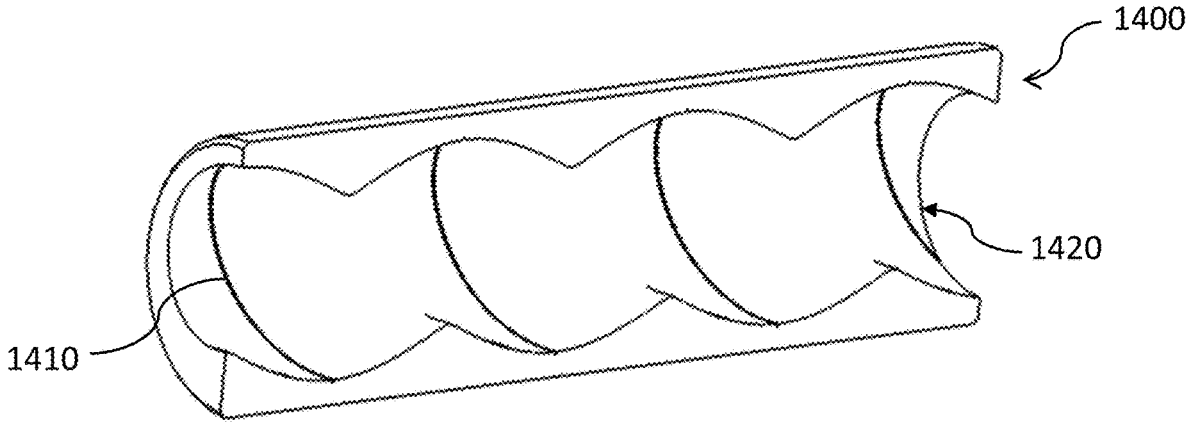
FIG. 14C is an isometric cross-sectional view of a rifled stator with a helical cavity and a single solids-handling groove formed in the inner surface of the stator.

FIGS. 14A, 14B and 14C show rifled stator 1400 with helical cavity 1420 and a single solids-handling groove 1410 formed in the inner surface of stator 1400.

Figure 15A:
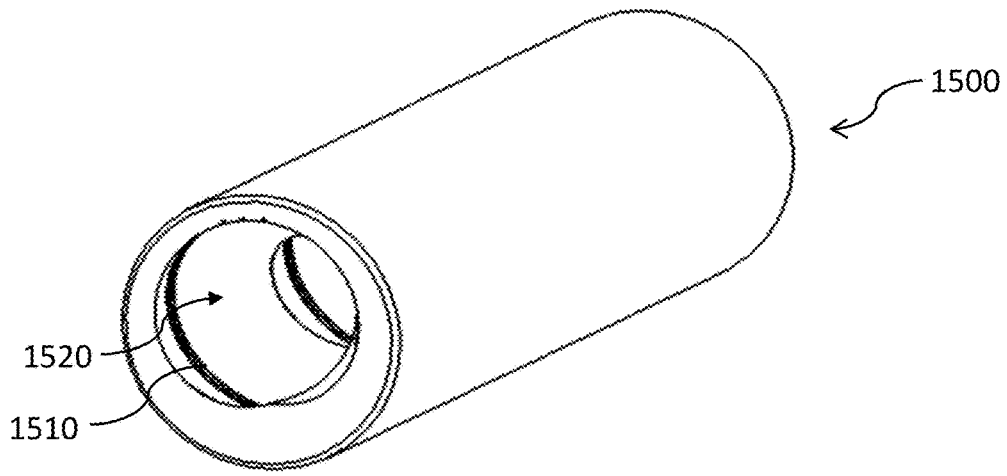
FIG. 15A is an isometric view of a rifled stator with a helical cavity and three solids-handling grooves formed in the inner surface of the stator.
Figure 15B:
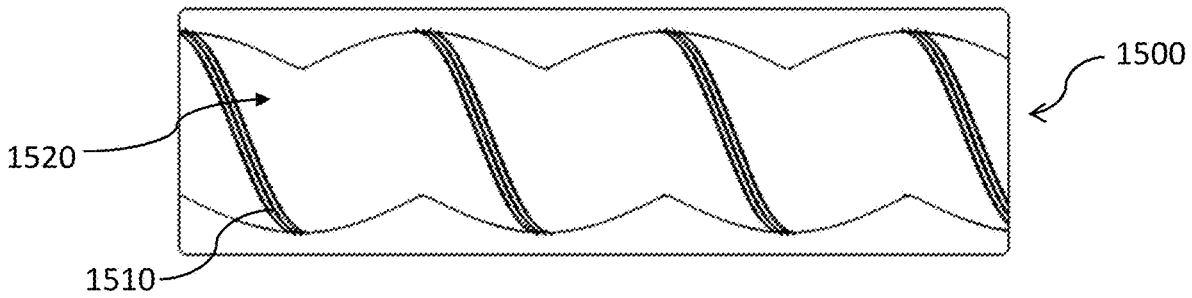
FIG. 15B is a side cross-sectional view of a rifled stator with a helical cavity and three solids-handling grooves formed in the inner surface of the stator
Figure 15C:
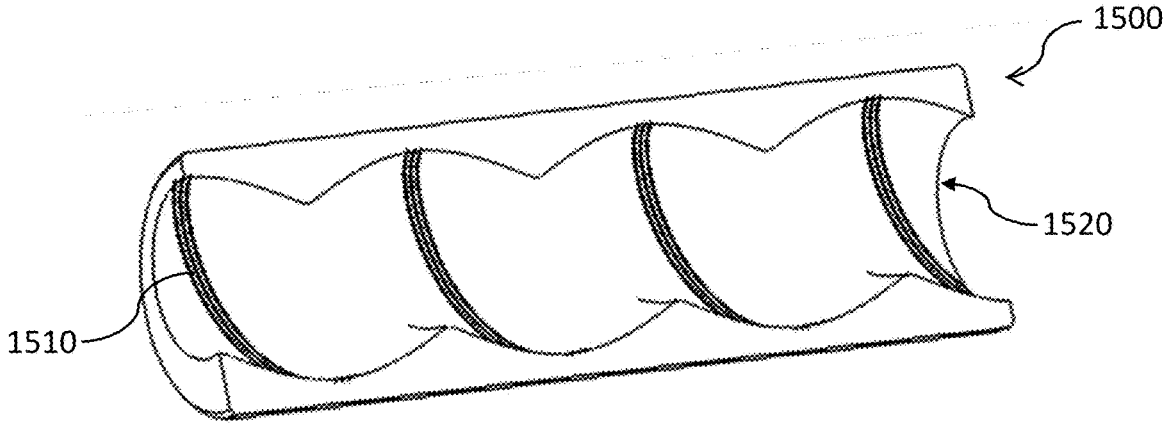
FIG. 15C is an isometric cross-sectional view of a rifled stator with a helical cavity and three solids-handling grooves formed in the inner surface of the stator.

FIGS. 15A, 15B and 15C show rifled stator 1500 with helical cavity 1520 and three solids-handling grooves 1510 formed in the inner surface of stator 1500.

Figure 16A:
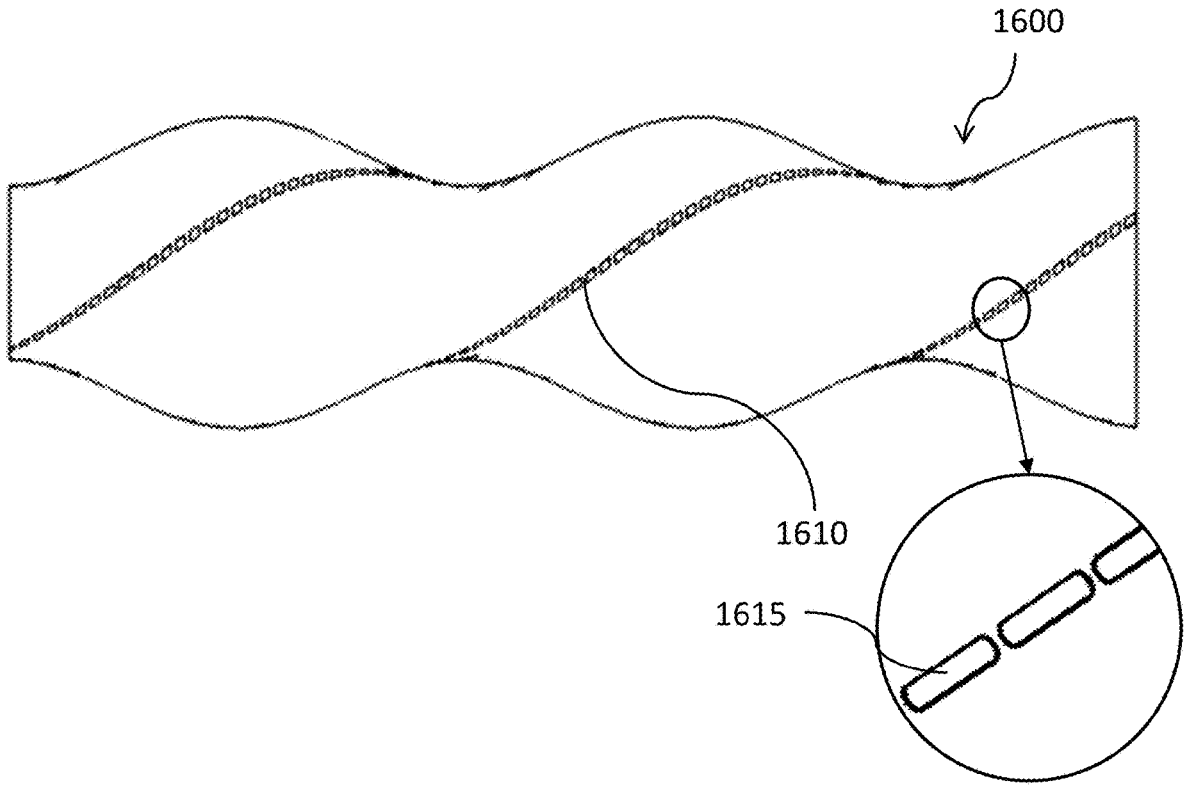
FIG. 16A is a side view of a helical rotor with a single "stitched" solids-handling groove formed in the rotor surface.
Figure 16B:
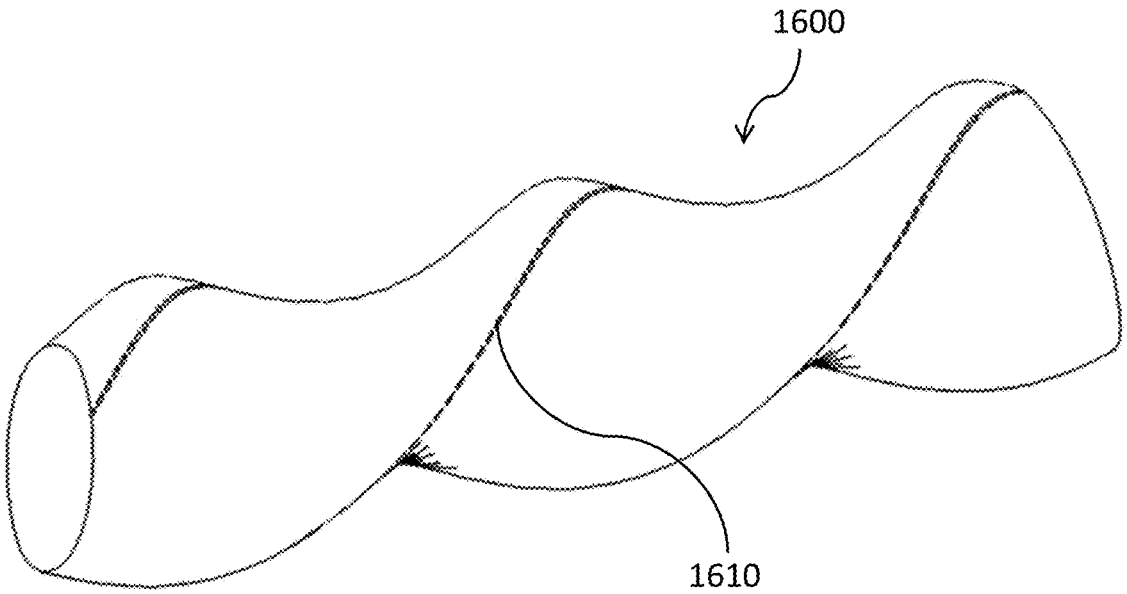
FIG. 16B is an isometric view of a helical rotor with a single "stitched" solids-handling groove formed in the rotor surface.

FIGS. 16A and 16B show helical rotor 1600 with a single "stitched" solids-handling groove 1610 formed in the rotor surface, winding around rotor 1600. Individual end-to-end slots or elongated cavities 1615 that form stitched groove 1610 are shown in the enlarged portion of the drawing in FIG. 16A. The use of non-stitched grooves can create leak paths under seals that can be mounted on the rotor and/or stator. Stitched grooves (or other non-continuous features) can be used to provide solids handling capability without creating such leak paths underneath the seals.

Figure 17A:
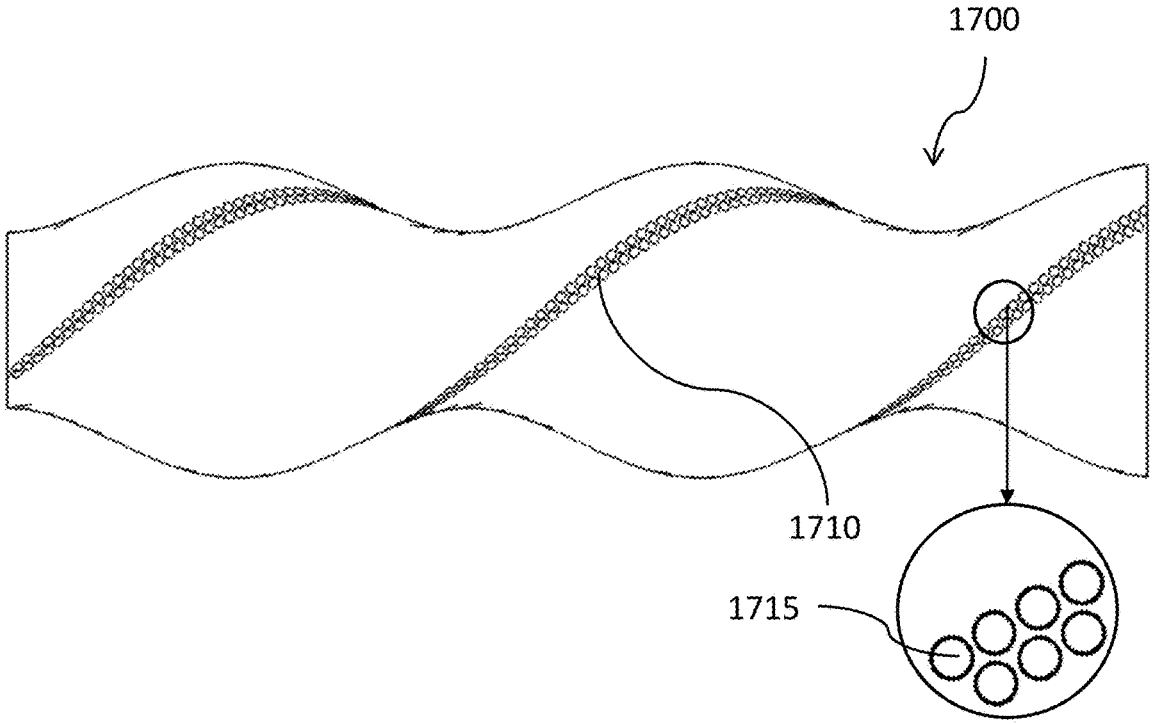
FIG. 17A is a side view of a helical rotor with a double row of cylindrical indentations formed in the rotor surface.
Figure 17B:
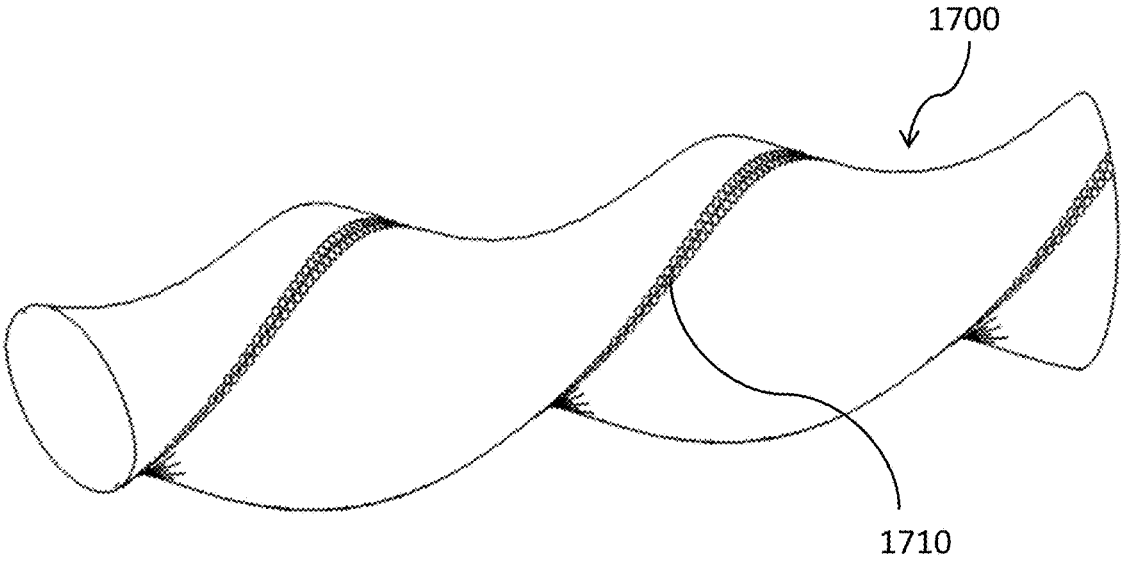
FIG. 17B is an isometric view of a helical rotor with a double row of cylindrical indentations formed in the rotor surface.

FIGS. 17A and 17B show helical rotor 1700 with a double row 1710 of cylindrical indentations formed in the rotor surface, winding around rotor 1700. Individual cylindrical indentations 1715 are shown in the enlarged portion of the drawing in FIG. 17A.

Figure 18:
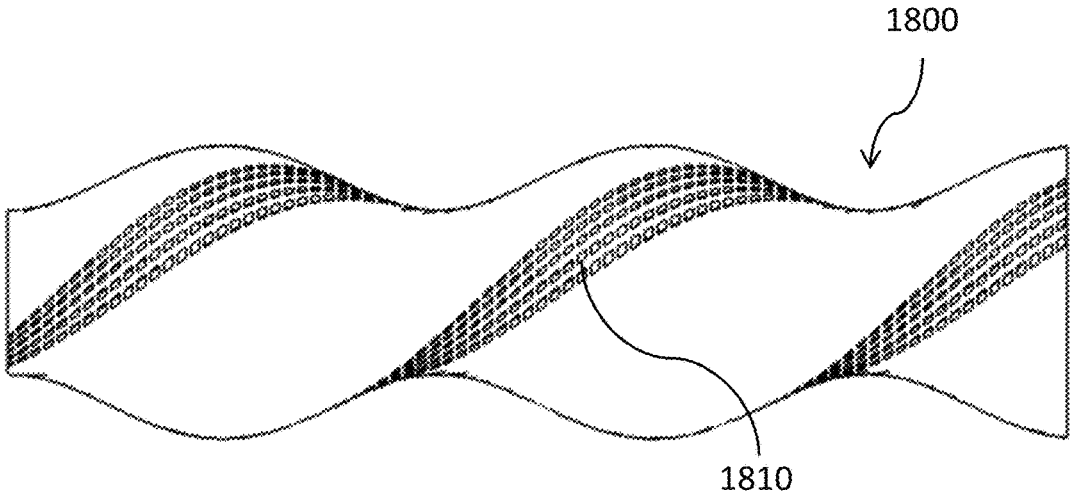
FIG. 18 is an isometric view of a helical rotor 1800 with four rows of square indentations formed in the rotor surface.

FIG. 18 shows helical rotor 1800 with four rows of square indentations 1810 formed in the rotor surface, winding around rotor 1800.

Figure 19A:
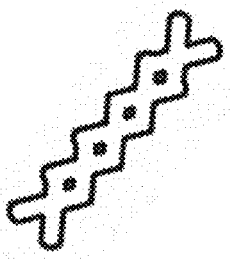
FIG. 19A illustrates an example of a solids-handling feature that can be used in the surface of a stator and/or rotor to accommodate solids.
Figure 19B:
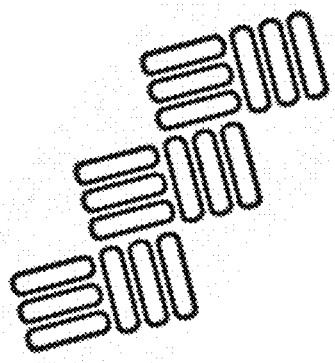
FIG. 19B illustrates an example of a solids-handling feature and a pattern that can be used in the surface of a stator and/or rotor to accommodate solids.
Figure 19C:
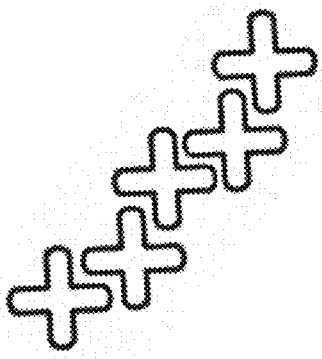
FIG. 19C illustrates an example of a solids-handling feature and pattern that can be used in the surface of a stator and/or rotor to accommodate solids.

FIGS. 19A, 19B and 19C illustrate examples of other solids-handling features and patterns that can be used in the surface of a stator and/or rotor to accommodate solids.

Figure 20A:
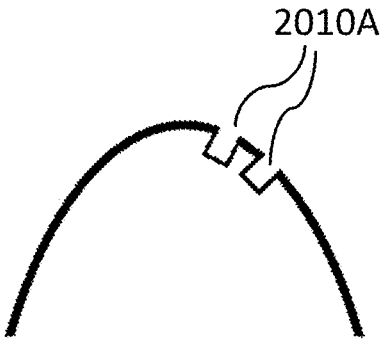
FIG. 20A is a cross-sectional view of a helical rotor with solids-handling features formed in the rotor surface, the features having a rectangular cross-section.
Figure 20B:
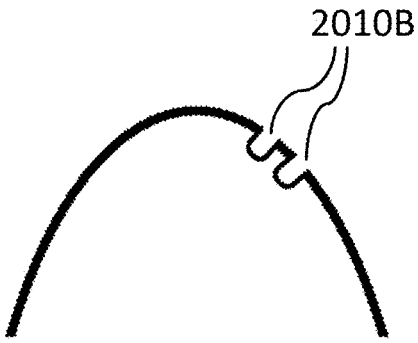
FIG. 20B is a cross-sectional view of a helical rotor with solids-handling features formed in the rotor surface, the features having a U-shaped cross-section.
Figure 20C:
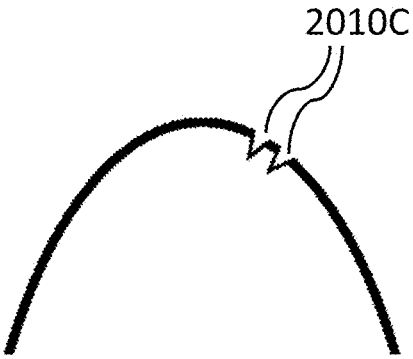
FIG. 20C is a cross-sectional view of a helical rotor with solids-handling features formed in the rotor surface, the features having a V-shaped cross-section.
Figure 20D:
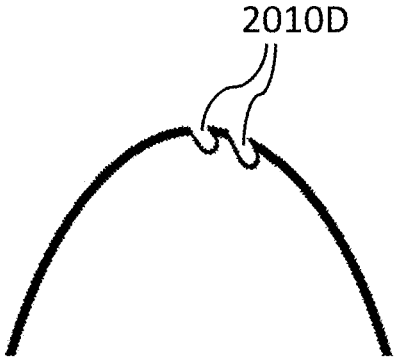
FIG. 20D is a cross-sectional view of a helical rotor with solids-handling features formed in the rotor surface, the features having an angled U-shaped cross-section.
Figure 20E:
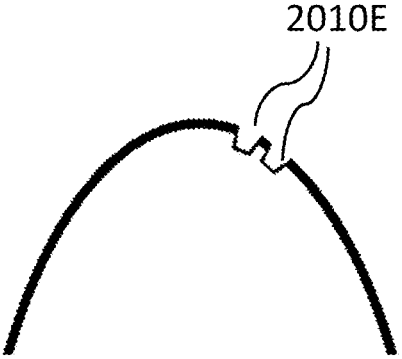
FIG. 20E is a cross-sectional view of a helical rotor with solids-handling features formed in the rotor surface, the features having a trapezoidal cross-section.
Figure 20F:
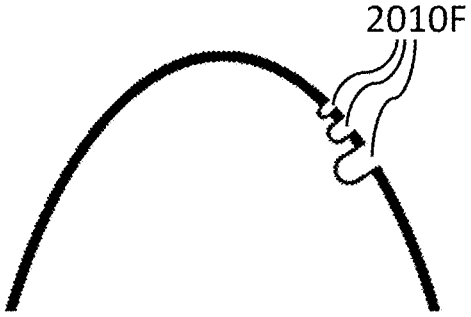
FIG. 20F is a cross-sectional view of a helical rotor with solids-handling features formed in the rotor surface, the features graded in size and having a U-shaped cross-section.

Grooves or other solids-handling features on the rotor and/or stator can have various cross-sectional profiles. Some examples of different cross-sectional profiles for solids-handling features (shown on a helical rotor with an approximately elliptical cross-section) are shown in the cross-sectional views of FIGS. 20A-F. FIG. 20A shows two features 2010A, which could be grooves, stitched grooves or elongated cavities, for example, having a rectangular cross-section. FIG. 20B shows two features 2010B having a U-shaped cross-section. FIG. 20C shows two features 2010C having a V-shaped cross-section. FIG. 20D shows two features 2010D having an angled U-shaped cross-section. FIG. 20E shows two features 2010E having a trapezoidal cross-section. FIG. 20F shows three features 2010F having a U-shaped cross-section, where the three features have differing dimensions—they are graded in size. In some embodiments, for example, a set of graded, parallel grooves with varying cross-section and/or width can be used on the leading side of the rotor and/or stator. The graded grooves can, for example, allow larger solids to enter the grooves early and then accommodate smaller solids closer to the rotor tip or inverse apex where sealing is important. Smaller grooves are generally better at maintaining adequate sealing, underneath or close to seals, than larger grooves. In some embodiments, graded stitched grooves can be used.

Figure 21A:
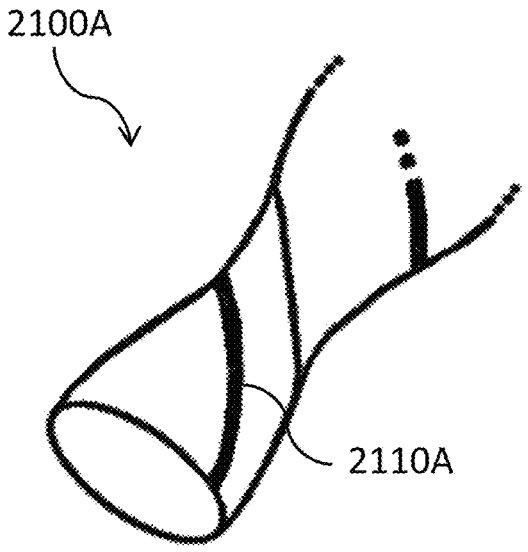
FIG. 21A is an isometric view of a helical rotor with a groove in the surface, the groove following the rotor pitch.
Figure 21B:
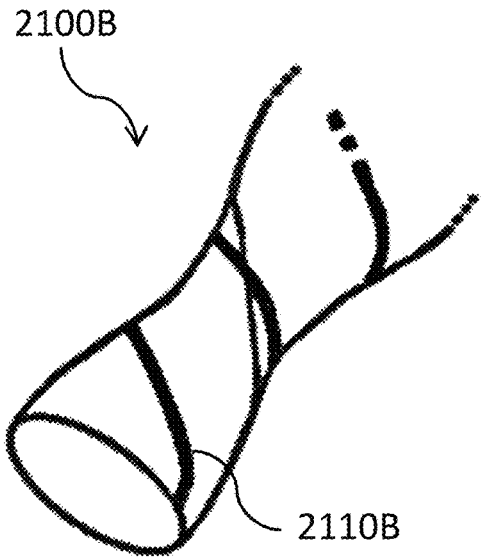
FIG. 21B is an isometric view of a helical rotor with a groove in the surface, the groove following the pitch of the contact path with a corresponding stator.
Figure 21C:
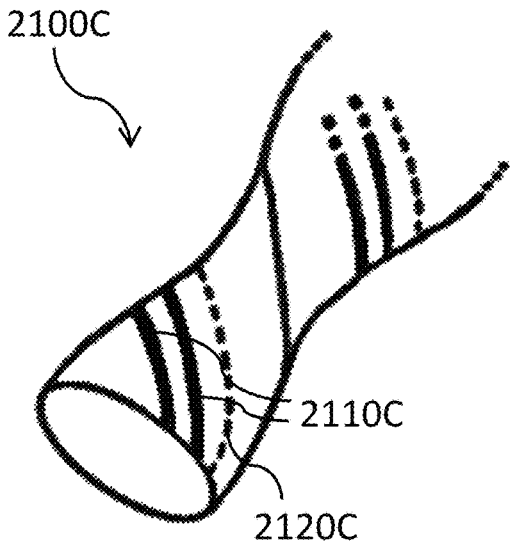
FIG. 21C is an isometric view of a helical rotor with a pair of grooves in the surface, the grooves following the rotor pitch and positioned to one side of the rotor crest.
Figure 21D:
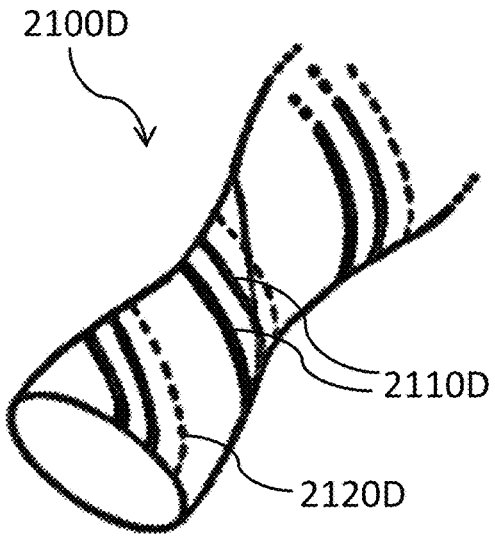
FIG. 21D is an isometric view of a helical rotor with a pair of grooves in the surface, the grooves following the pitch of the contact path with a corresponding stator and positioned to one side of the contact path.

Solids-handling features, such as those described above, can be positioned along various paths on the rotor and/or stator. For example, FIG. 21A shows groove 2110A, on helical rotor 2100A, that follows the rotor pitch. FIG. 21B shows groove 2110B, on helical rotor 2100B, that follows the pitch of the corresponding stator apex path as it contacts the rotor. In some embodiments the stator apex path is a narrow helical path as would be made by a sharp stator apex, for example. In some embodiments the stator apex path can be a near helical path that follows the sweeping contact of a stator apex region with the rotor, as in a machine with offset geometry for example. This near helical path can represent a seal path between the rotor and stator. One or more solids-handling grooves can be positioned within such a seal path (for example, running within and parallel to the seal path). This can provide better sealing (and less fluid slip) than if solids-handling grooves cross or span the seal path and create a path for fluids to bypass the seal between the rotor and stator, thereby increasing the slip within the pump. FIG. 21C shows a pair of grooves 2110C, on helical rotor 2100C that follows the rotor pitch but is positioned to one side of the rotor crest (or tip in cross-section). Dashed line 2120C follows the rotor pitch and indicates a path along the rotor crest. In some embodiments, 2120C represents another groove or a stitched groove. In other embodiments, there is no groove along this path. FIG. 21D shows a pair of grooves 2110D, on helical rotor 2100D that follows the pitch of the corresponding stator but is positioned to one side of where the stator contacts the rotor. Dashed line 2120D follows the stator pitch and indicates a path where the stator contacts the rotor. In some embodiments, 2120D represents another groove or a stitched groove. In other embodiments, there is no groove along this path. Embodiments where the grooves are offset from the contact path (or seal path) between the rotor and stator, this can allow for controlled fluid slip to clear the grooves since they are not totally aligned with seal lines, but can also allow for smoother groove ridge sliding of the groove ridge against the adjacent surface or seal (stator apex or rotor tip).

In some embodiments, grooves or other solids-handling features on the rotor can follow the demarcation path between the tip and flank of the rotor—in other words they can be positioned along the boundary between the rotor tip and flank. Equation (2) can be used to describe this demarcation path. In embodiments of the rotary machines, higher wear rates tend to occur in this region, so, at least in some embodiments, placing a groove or other solids handling feature(s) along this path can be advantageous.

$$W_R = 2(R-E)\sqrt{\frac{1}{2}-\frac{E}{2R}} - 2O\sqrt{\frac{1}{2}+\frac{E}{2R}} \tag{2}$$

Figure 22A:
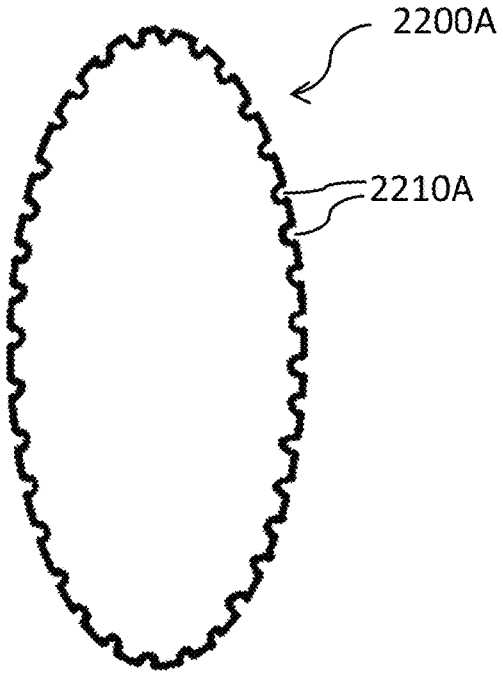
FIG. 22A is a transverse cross-sectional illustration of a helical rotor with U-shaped grooves around the full profile of the rotor.
Figure 22B:
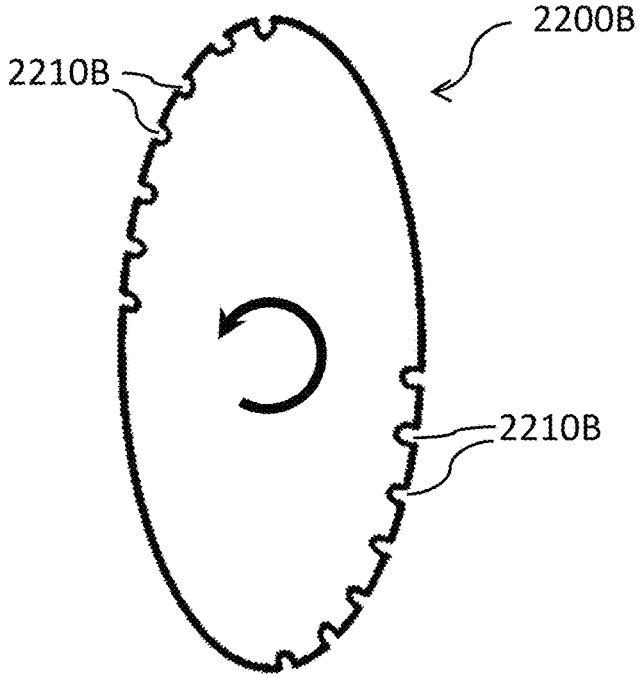
FIG. 22B is a transverse cross-sectional illustration of a helical rotor with U-shaped grooves on the leading quadrants of the rotor.
Figure 22C:
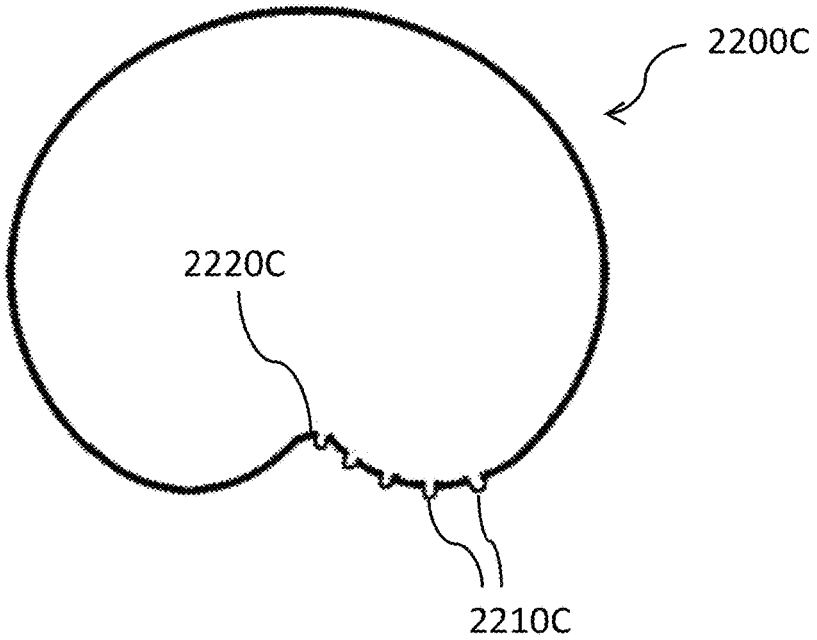
FIG. 22C is a transverse cross-sectional illustration of a helical stator with U-shaped grooves on the inverse apex and to one side of the inverse apex.

Solids-handling features, such as those described above, can be positioned at various locations around the outer surface of a helical rotor or inner surface of a helical stator (e.g. relative to the rotor tip or stator inverse apex), and they can be positioned symmetrically or not. For example, FIG. 22A is a transverse cross-sectional illustration of helical rotor 2200A with U-shaped grooves 2210A around the full profile of the rotor. FIG. 22B is a transverse cross-sectional illustration of helical rotor 2200B with U-shaped grooves 2210B on the leading quadrants of the rotor only (the direction of rotation of the rotor is indicated by the arrow). It has been observed that wear does tend to occur more on the leading quadrants of the rotor, as this is where solids in the fluid chambers in the pump tend to become crushed and scrape the contact surfaces. FIG. 22C is a transverse cross-sectional illustration of helical stator 2200C with U-shaped grooves 2210C on the inverse apex and to one side of inverse apex 2220C. This could be the leading or trailing side, depending on the direction of rotation of the rotor relative to the stator.

Figure 23A:
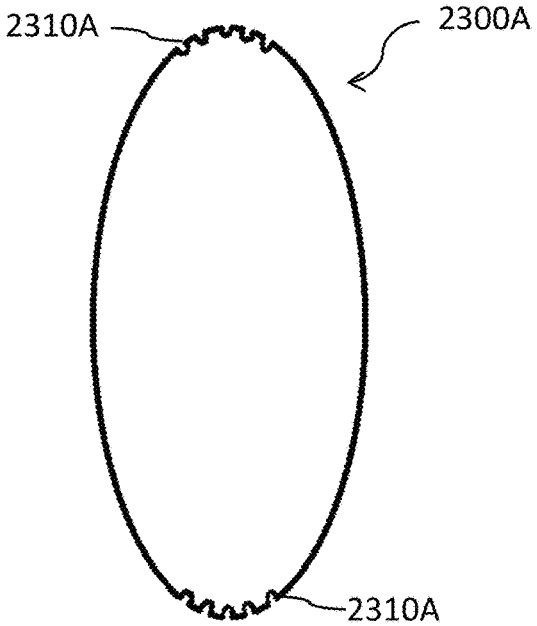
FIG. 23A is a transverse cross-sectional illustration of a helical rotor with U-shaped grooves symmetrically positioned around the rotor tips.
Figure 23B:
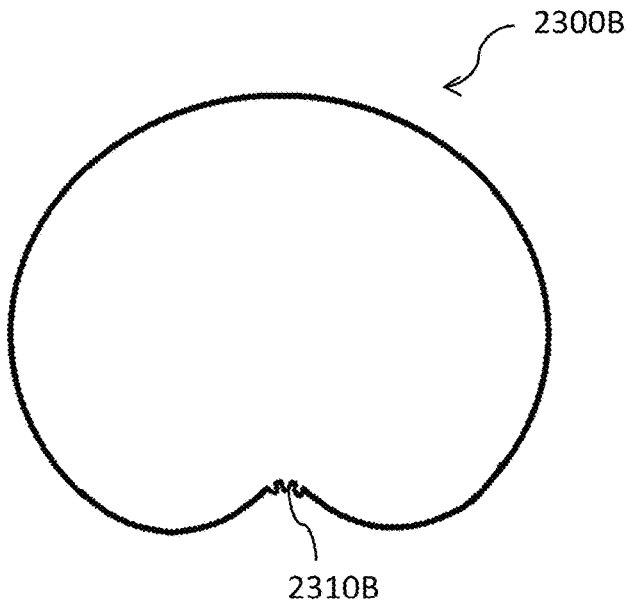
FIG. 23B is a transverse cross-sectional illustration of a helical stator with U-shaped grooves on the inverse apex.
Figure 23C:
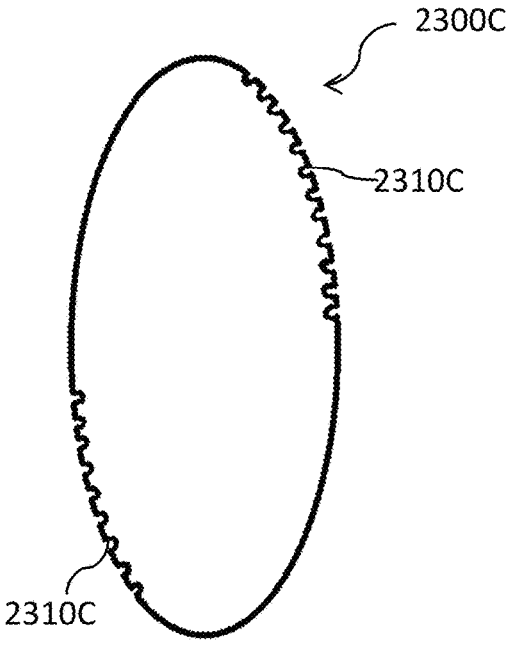
FIG. 23C is a transverse cross-sectional illustration of a helical rotor with U-shaped grooves on the flank regions of opposing quadrants (leading or trailing) of the rotor.
Figure 23D:
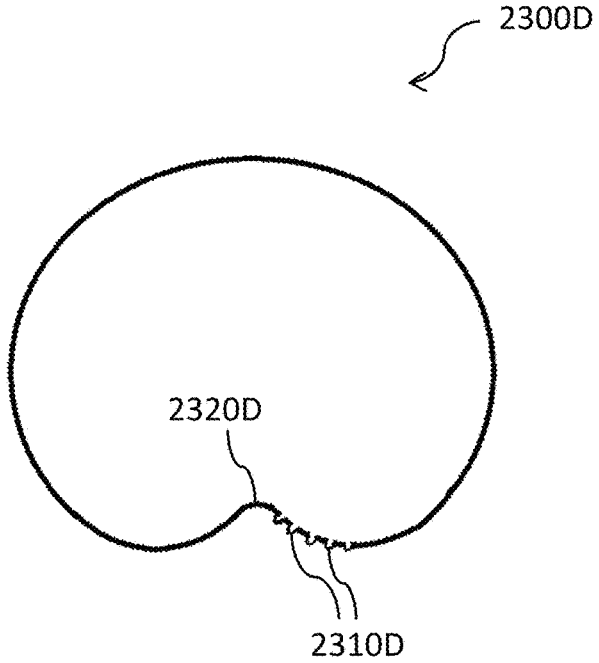
FIG. 23D is a transverse cross-sectional illustration of a helical stator with U-shaped grooves on the flank region to one side of the inverse apex.

FIG. 23A is a transverse cross-sectional illustration of helical rotor 2300A with U-shaped grooves 2310A symmetrically positioned only around the rotor tips. FIG. 23B is a transverse cross-sectional illustration of helical stator 2300B with U-shaped grooves 2310B on the inverse apex. FIG. 23C is a transverse cross-sectional illustration of helical rotor 2300C with U-shaped grooves 2310C only on the flank regions of opposing quadrants (leading or trailing) of the rotor—not at the rotor tips. FIG. 23D is a transverse cross-sectional illustration of helical stator 2300D with U-shaped grooves 2310D only on the flank region to one side of inverse apex 2320D.

Sealing Configurations for Improved Solids Handling

Some embodiments of the rotary machines operate with a small clearance between the helical rotor and stator, but without seals between them. In some embodiments it can be desirable to dispose a dynamic seal between these components to reduce leakage of fluid between stages. Sealing in helical trochoidal rotary machines is discussed in U.S. Pat. No. 10,844,859, which is incorporated by reference herein.

In some embodiments of helical trochoidal rotary machines, various rotor seal and/or stator seal configurations can be used to improve the solids handling capability of the machines. For example, the following can be considered in selecting a rotor seal configuration that can improve the solids handling capability of such rotary machines. Similar considerations can be applied to stator seals.

Positioning and Asymmetry: Dynamic seals can be positioned either on the leading tip/flank, or trailing tip/flank of the rotor.

Seal Range or Span: For example, in terms of seal width, a dynamic seal can start somewhere on the rotor tip and end somewhere in the flank. The seal range could include a portion, half, or most of the rotor tip.

Seal Face: The exposed seal surface can be shaped to match the rotor or stator profile, or the surface of the seal can have grooves, protrusions and/or other features to aid in solids handling or fines control. The seal surfaces can include other materials, such as bristles, hairs, broom-like features, and/or durable but flexible synthetic materials.

Function: The seal can be configured to serve more as a scraper, rather than being designed primarily to reduce fluid slip.

Figure 24A:
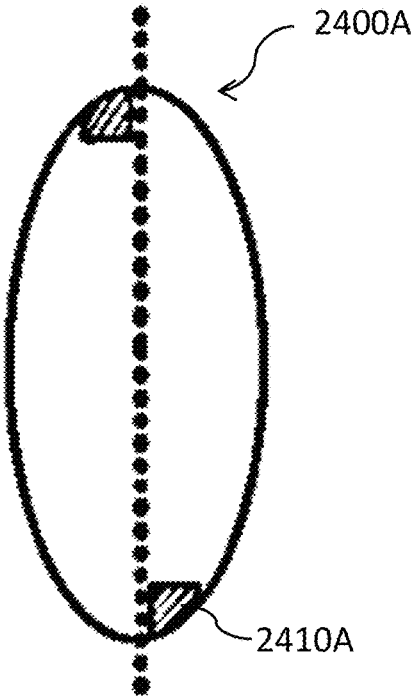
FIG. 24A is a transverse cross-sectional illustration of a helical rotor with an asymmetric seal.

Seal cavity shape: The shape of the seal cavity that a dynamic seal sits within has implications on the reactive forces that the seal can exert on the pump contact surfaces. Depending on the mechanism chosen to provide reactive forces, the choice of seal cavity shape can have implications on the dynamic response of the pump. For example, in some embodiments it can be advantageous to use an asymmetric seal on the tip of the rotor and/or the stator inverse apex. FIG. 24A is a transverse cross-sectional illustration of single-start helical rotor 2400A with single asymmetric seal 2410A that winds along one side of the rotor crest such that (in cross-section) it is positioned to occupy half of the width of the rotor tip. In some such embodiments this "partial width" seal is used on the trailing side of the rotor tip, and the leading portion of the rotor tip that tends to be subject to more wear is a stiff sliding surface (e.g. metal). In such an arrangement, the primary function of the seal can be to reduce fluid slip from the backside of the rotor, rather than to participate in high friction areas where wear tends to occur. In some embodiments, an asymmetric seal can be used on the leading portion of the rotor tip where wear tends to occur. The exposed surface of seal 2410A in FIG. 24A is smooth and is shaped to match the rotor profile.

Figure 24B:
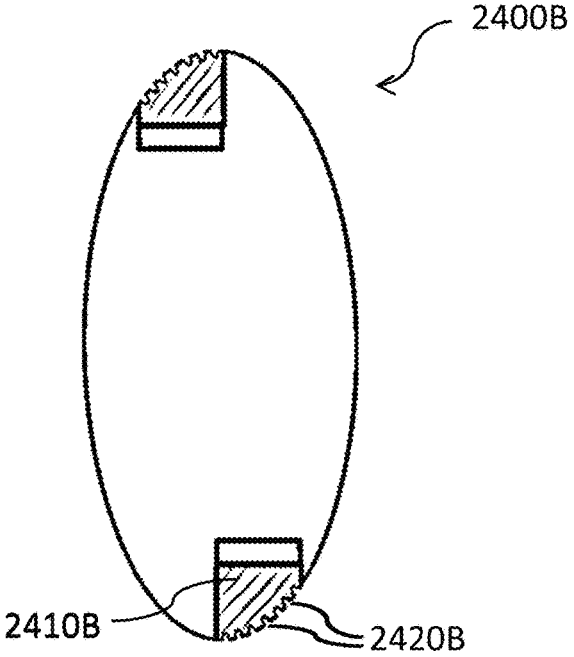
FIG. 24B is a transverse cross-sectional illustration of a helical rotor with an asymmetric seal that has grooves formed in its exposed surface.

FIG. 24B is a transverse cross-sectional illustration of single-start helical rotor 2400B, again with single asymmetric seal 2410B that winds along one side of the rotor crest such that (in cross-section) it is positioned to occupy half of the width of the rotor tip. Seal 2410B has grooves 2420B formed in its exposed surface. Such seal grooves can improve solids handling of rotary machine incorporating such a rotor and dynamic seal. Such grooves and/or other features on the fluid-facing surfaces of the rotor seal can accommodate solids not caught or squeezed between the seal and the surface of the stator as the stator slides by the rotor as a liquid containing the solids is pumped.

Figure 24C:
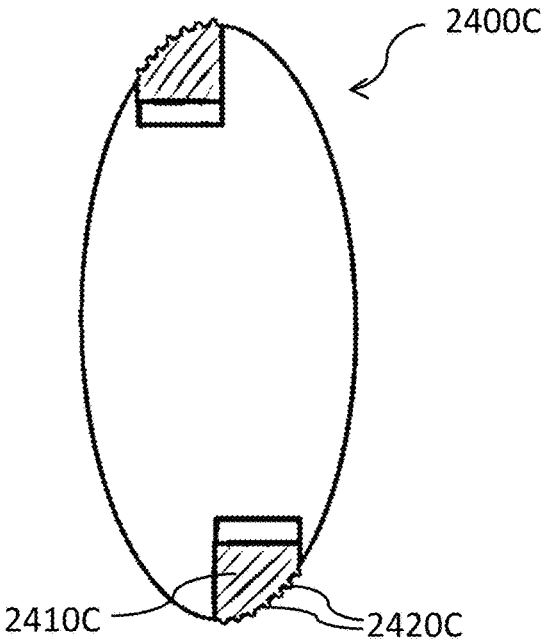
FIG. 24C is a transverse cross-sectional illustration of a helical rotor with an asymmetric seal that has protrusions extending from its exposed surface.

FIG. 24C is a transverse cross-sectional illustration of single-start helical rotor 2400C, again with single asymmetric seal 2410C that winds along one side of the rotor crest such that (in cross-section) it is positioned to occupy half of the width of the rotor tip. Seal 2410C has protrusions 2420C extending from its exposed surface; these extend beyond the profile of the rotor.

Figure 24D:
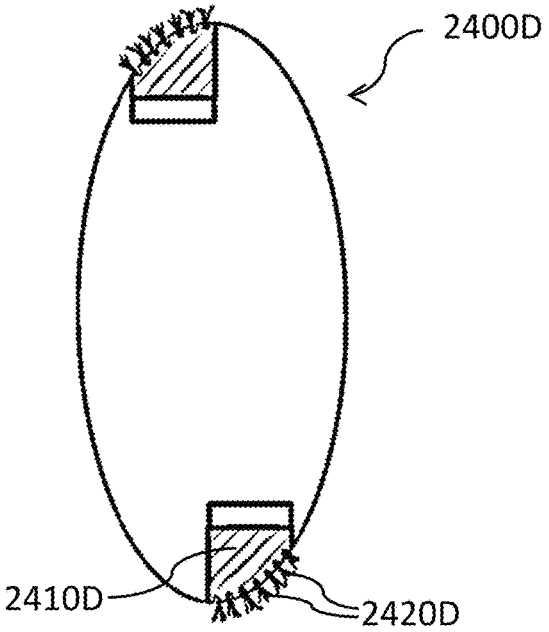
FIG. 24D is a transverse cross-sectional illustration of a helical rotor with an asymmetric seal that has bristles extending from its exposed surface.

FIG. 24D is a transverse cross-sectional illustration of single-start helical rotor 2400D, again with single asymmetric seal 2410D that winds along one side of the rotor crest such that (in cross-section) it is positioned to occupy half of the width of the rotor tip. Seal 2410D has bristles 2420D extending from its exposed surface. Such protrusions and/or bristles can aid in solids handling.

Figure 25:
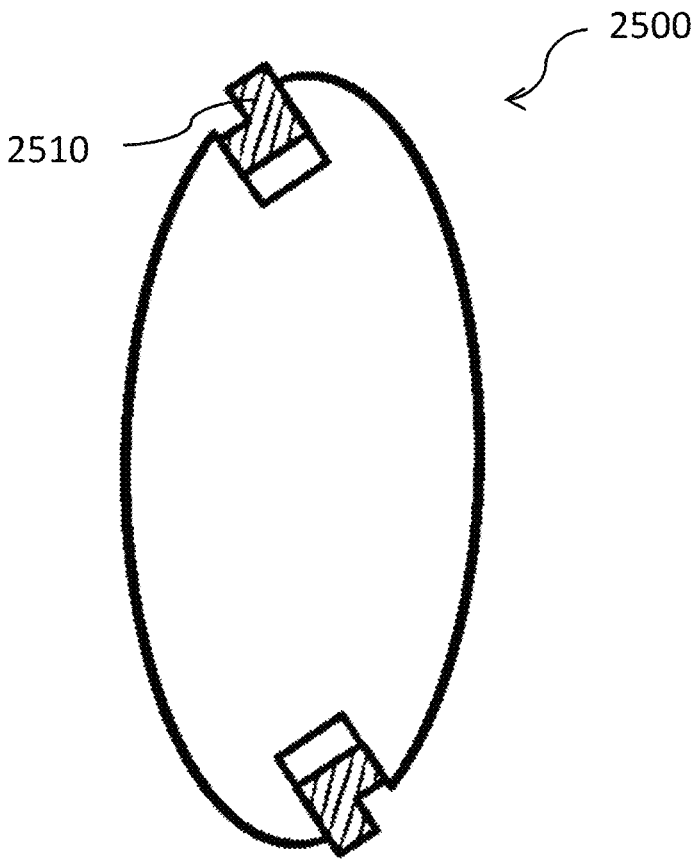
FIG. 25 is a transverse cross-sectional illustration of a helical rotor, with an asymmetric seal that is configured to act as a scraper, as well as functioning as a dynamic seal.

FIG. 25 is a transverse cross-sectional illustration of single-start helical rotor 2500, with single asymmetric seal 2510 that is configured to act as a scraper, as well as functioning as a dynamic seal. Seal 2510 winds along one side of the rotor crest. In some embodiments such a seal can be positioned as a leading flank rotor seal which is exposed to solids such as sand and fines and performs as a scraper to clear the path for the rotor tip.

Fluid Chamber Geometry & Orientation

Solids collecting in the tail-end of the fluid chambers in some embodiments of helical trochoidal rotary machines can be a cause of abrasive wear. In some embodiments, this tail-end region is a long, tapered region with a high surface-area:volume ratio. Thus, this region can have a high negative impact on wear properties, with relatively little positive impact on volumetric flow. Thus, minimizing or at least reducing this region—or equivalently, maximizing or at least increasing the angular difference between the rotor and stator surface angles at contact locations—can, at least in some embodiments, be beneficial for improving solids handling performance.

This can be accomplished, for example, by selecting machine geometry parameters, including for example pump eccentricity (E) as well as (in at least some embodiments more importantly) pitch, so that the fluid chambers have dimensions and shape that are more conducive to handling solids with less tendency for wear. As pitch can have a significant impact on pump performance characteristics, a change in pitch will generally necessitate large changes in cross-sectional geometry, if particular pump characteristics are to be maintained. For example, decreasing pitch (which beneficially increases the angularity of the tail-ends of the fluid chambers) proportionally decreases the volumetric flow per revolution. A proportional increase in cross-sectional area can be used in order to achieve the same volumetric flow. This implies that a helical trochoidal rotary pump with superior solids handling, but equivalent theoretical flow rate, would generally tend to be radially larger. For some applications, it may not be possible to accommodate a pump with a larger radius. For example, for pumps that are required to be compatible with existing oil well assemblies, there may be limit to how far pitch can be adjusted before the pump exceeds the sizing constraints.

Changes to the eccentricity ratio, E/(R−O), of helical trochoidal rotary pumps also alter the shape of the rotor and stator—and therefore the shape of the fluid chambers and the rotor-stator contact angularity—for example, as described above in reference to FIGS. 10A-C. Combining selection of pitch with selection of eccentricity ratio allows for control over both fluid chamber contact angularity and pump flow characteristics, so that desired characteristics for a particular machine and end-use application can be achieved, along with improved solids handling.

As described above in reference to FIGS. 6 and 7, some embodiments of the rotary machines described herein have the rotor held at a specific eccentricity relative to the stator, and are operated such that the rotor spins about its longitudinal axis, but does not orbit, and the stator spins about its longitudinal axes. Unlike embodiments where the stator is fixed, in pumps having this configuration the fluid is transported by chambers that just translate; the fluid chambers do not spin. When such pumps are oriented horizontally, the tail-ends of the fluid chambers can be oriented such that gravity can facilitate movement of solids away from these sensitive locations. For example, the pump can be positioned so that the tail-ends of the fluid chambers are positioned directly above the central axis of the pump, so that solids that migrate due to gravity and move away from the fluid chamber transition regions.

Pairing this orientation of such pumps with various intake geometries can aid in keeping solids, such as sand and fines, away from the contact surfaces and regions that tend to wear within the pump. For example, if the intake plumbing through which the fluid is drawn into the pump is a tornado shape that causes solids to migrate towards the outside and then enter into the horizontally oriented pump such that solids are mainly at the bottom, this can divert solids away from the sliding parts that otherwise tend to be subject to wear.

Rotor-Stator Geared Gap

In some embodiments of helical trochoidal rotary pumps, the rotor and stator can be supported and geared such that the rotor and stator are held at a fixed position relative to one another, and optionally so that the input crank rotates both the rotor and stator. In some embodiments, the gap between the rotor and stator can be held constant. In some embodiments, the size of this gap can be selected such that it is larger than the solids contained in the fluid that the pump is intended to transport.

Much of the description herein has focused on embodiments of helical trochoidal rotary machines with a trochoidal rotor (and particularly on pumps with an elliptical or approximately elliptical rotor) and corresponding outer envelope stator cavity. In other embodiments, helical trochoidal rotary machines can have an epitrochoidal stator cavity profile and corresponding rotor (inner envelope) profile that are each swept along helical paths. These embodiments have the same relative motion of the rotor and stator (with the same orbit and spin) as machines with a trochoidal rotor and corresponding outer envelope stator cavity. The present approach can be applied to generate embodiments of helical rotary machines based on a hypotrochoidal or epitrochoidal rotor, where the components have more than two or three lobes.

In various embodiments, the rotor and/or optionally the stator can be rotated using any suitable drive mechanism.

Much of the description herein has focused on embodiments of helical trochoidal rotary machines in which the rotor and stator pitch and all dimensions (including a, b and E, R and O as shown in FIGS. 8A-C) remain constant along the length of the rotor-stator assembly, where the volume and dimensions of the fluid chambers formed between the helical rotor and the stator are the same along the length of the assembly.

In other multi-stage embodiments, the rotor-stator geometry can be varied, in a continuous or stepwise manner, along the axis of the rotary machine. In some embodiments, such variations can cause the volume of the fluid chambers to vary along the axis of the machine, such as may be desirable for compressor or expander applications, for example. In other embodiments, it can be advantageous to vary the geometry of the rotor-stator along the axis of the rotary machine, while keeping the volume of the fluid chambers formed between the helical rotor and the stator approximately the same along a length of the rotor-stator assembly. The various approaches to solids handling described above (e.g. use of rifling and/or other features on the rotor and/or stator, modified configuration of seals, and/or selection of machine geometry and/or orientation) can also be applied in helical trochoidal rotary machines in which the rotor-stator geometry varies along the axis of the rotary machine.

Figure 26:
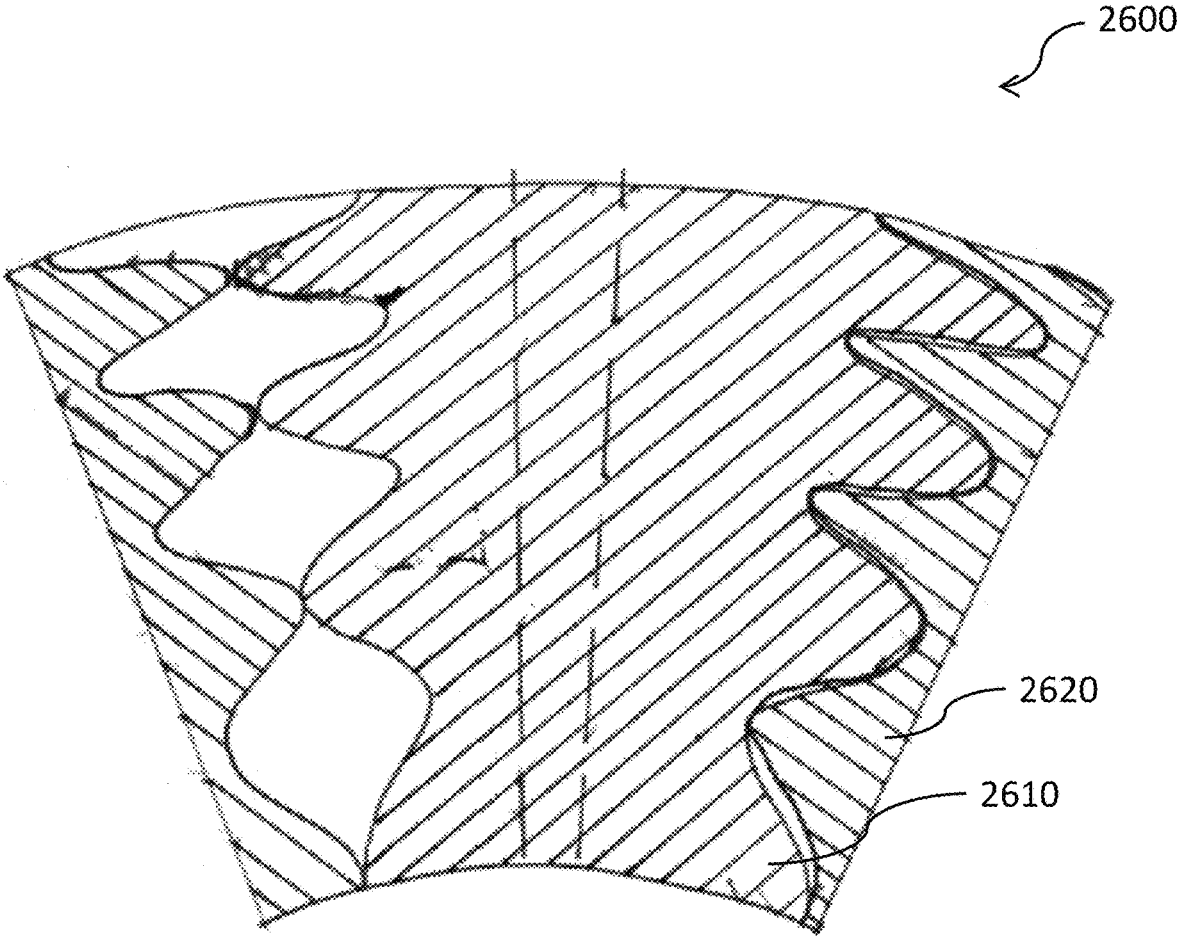
FIG. 26 is a simplified cross-sectional drawing of a portion of a rotor-stator assembly from a rotary machine, in which the geometry of the rotor-stator varies along the axis of the assembly.

FIG. 26 is a simplified illustration of a portion of a rotor-stator assembly 2600 from a rotary machine in cross-section, to illustrate an embodiment in which the geometry of the rotor-stator varies along the axis of the rotary machine. In this embodiment, multiple parameters (e.g. diameter, pitch etc.) are varied in combination so that the volume of the fluid chambers formed between a helical rotor 2610 and a corresponding stator 2620 remains approximately the same along a length of rotor-stator assembly 2600. In the illustrated embodiment, the rotor and stator axes are non-parallel.

Figure 27:
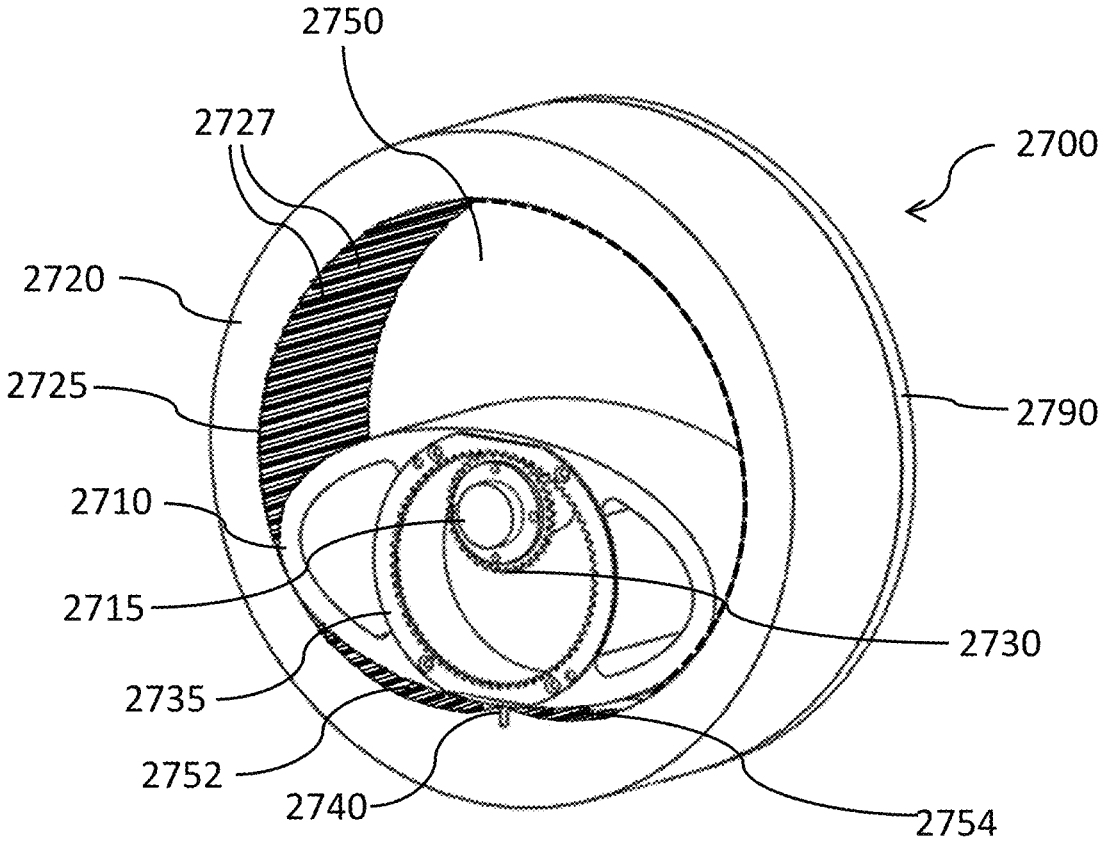
FIG. 27 is an isometric front-view of a rotor-stator assembly for a rotary machine, where the inner surface of the stator has grooves formed therein.

Similarly, the various approaches to solids handling described herein can be applied rotary machines that have similar trochoidal geometries, but where the rotor and stator are not helicized, such as for example rotary machines described in U.S. Pat. No. 10,087,758, which is incorporated by reference herein. In various embodiments of such machines, solids-handling features can be incorporated into the fluid-facing surface of the stator or rotor. For example, FIG. 27 shows an isometric view of an embodiment of rotor-stator assembly 2700 for a rotary machine, having elliptical rotor 2710 inside stator 2720. In this embodiment stator 2720 has inner surface 2725 (fluid-facing surface) comprising a plurality of grooves 2727 for improved solids handling. Inner surface 2725 has an inverse apex 2740 that is in contact with elliptical rotor 2710 throughout rotation of elliptical rotor 2710. Assembly 2700 has crankshaft 2715 that turns ring gear 2735 by means of a mechanical coupling (not shown). The mechanical coupling is configured to hold ring gear 2735 against sun gear 2730, keeping the crank arm length constant at all times during rotation. Ring gear 2735 is fixed to elliptical rotor 2710, and rotates about sun gear 2730, resulting in eccentric rotation of elliptical rotor 2710 about the center axis of crankshaft 2715. Elliptical rotor 2710 is in contact with stator inner surface 2725 at two or three places (depending on the rotational position of the rotor), and divides the interior volume of stator 2720 into two or three working chambers, for example chambers 2750, 2752 and 2754 of FIG. 27. Elliptical rotor 2710 is held within stator 2720 by first planar wall 2790 at the rear of assembly 2700 and a second planar wall (not shown) at the front of assembly 2700.

Throughout the following description, specific details are set forth in order to provide a more thorough understanding of the invention. However, the invention can be practiced without these particulars. In other instances, well-known elements have not been shown or described in detail to avoid unnecessarily obscuring the description. Accordingly, the specification and drawings are to be regarded in an illustrative, rather than a restrictive sense.

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to";

"connected", "coupled", or any variant thereof, means any connection or coupling, either direct or indirect, permanent, or non-permanent, between two or more elements; the coupling or connection between the elements can be physical, logical, or a combination thereof;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms.

Unless otherwise indicated, words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description, depend on the specific orientation of the apparatus described and illustrated. The subject matter described herein can assume various orientations. Accordingly, these directional terms are not strictly defined and should not be interpreted narrowly.

Where a component is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which perform the function of the described component.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

While particular elements, embodiments and applications of the present invention have been shown and described, it will be understood that the invention is not limited thereto since modifications can be made by those skilled in the art without departing from the scope of the present disclosure, particularly in light of the foregoing teachings.

What is claimed is:

1. A rotary machine comprising an outer-member and a rotor disposed within said outer-member, said rotor having a rotor helical profile, and a rotor axis, and having a hypotrochoidal rotor shape at any cross-section transverse to said rotor axis along at least a portion of a length of said rotor that is hypotrochoidal, said rotor configured to undergo planetary motion relative to said outer-member, said rotor configured to spin about said rotor axis; and said outer-member having an outer-member helical profile, an outer-member axis, and an outer-member shape at any cross-section transverse to said outer-member axis along at least a portion of a length of said outer-member that is an outer envelope formed when said hypotrochoidal rotor shape undergoes planetary motion, said outer-member configured to spin about said outer-member axis;

wherein said rotary machine is a multi-stage machine having a plurality of chambers between a fluid-facing surface of said rotor and a fluid-facing surface of said outer-member; and wherein said rotor and said outer-member are held at a fixed eccentricity with said rotor axis offset relative to said outer-member axis so that, during operation of said rotary machine, said rotor undergoes planetary motion relative to said outer-member without orbiting; and wherein said rotor comprises an at least one rotor solids-handling feature formed in said fluid-facing surface of said rotor and extending along a first helical path on said fluid-facing surface of said rotor, and/or said outer-member comprises an at least one outer-member solids-handling feature formed in said fluid-facing surface of said outer-member and extending along a second helical path on said fluid-facing surface of said outer-member.

2. The rotary machine of claim 1 wherein:

said hypotrochoidal rotor shape has n lobes, where n is an integer;

said outer-member shape has (n−1) lobes;

the pitch of said rotor is the same as the pitch of said outer-member; and the ratio of the lead of said rotor to the lead of said outer-member is n:(n−1).

3. The rotary machine of claim 2 wherein said hypotrochoidal rotor shape is an ellipse, and n=2.

4. The rotary machine of claim 3 wherein:

said outer-member comprises an inverse apex which, during operation of said rotary machine, contacts said fluid-facing surface of said rotor along a contact path; and said rotor comprises said at least one rotor solids-handling feature, said at least one rotor solids-handling feature comprising a plurality of grooves formed in said fluid-facing surface of said rotor and extending along said first helical path on said fluid-facing surface of said rotor; and wherein said first helical path is aligned with said contact path.

5. The rotary machine of claim 1 wherein, if present, said at least one rotor solids-handling feature comprises an at least one groove formed in said fluid-facing surface of said rotor and wherein, if present, said at least one outer-member solids-handling feature comprises an at least one groove formed in said fluid-facing surface of said outer-member.

6. The rotary machine of claim 1 wherein, if present, said at least one rotor solids-handling feature comprises a first plurality of grooves formed in said fluid-facing surface of said rotor and wherein, if present, said at least one outer-member solids-handling feature comprises a second plurality of grooves formed in said fluid-facing surface of said outer-member.

7. The rotary machine of claim 1 wherein, if present, said at least one rotor solids-handling feature comprises an at least one stitched groove formed in said fluid-facing surface of said rotor and wherein, if present, said at least one outer-member solids-handling feature comprises an at least one stitched groove formed in said fluid-facing surface of said outer-member.

8. The rotary machine of claim 1 wherein, if present, said at least one rotor solids-handling feature comprises a first plurality of indentations formed in said fluid-facing surface of said rotor and wherein, if present, said at least one outer-member solids-handling feature comprises a second plurality of indentations formed in said fluid-facing surface of said outer-member.

9. The rotary machine of claim 1 wherein, if present, said at least one rotor solids-handling feature is positioned asymmetrically in said fluid-facing surface of said rotor and wherein, if present, said at least one outer-member solids-handling feature is positioned asymmetrically in said fluid-facing surface of said outer-member.

10. A rotary machine comprising an outer-member and a rotor disposed within said outer-member, said rotor having a rotor axis and a rotor helical profile, wherein said rotor has a rotor shape at any cross-section transverse to said rotor axis along at least a portion of a length of said rotor that is inwardly offset from a hypotrochoidal shape, said rotor configured to undergo planetary motion relative to said outer-member; and said outer-member having an outer-member axis and an outer-member helical profile, and an outer-member shape at any cross-section transverse to said outer-member axis along at least a portion of a length of said outer-member that is an outer envelope formed when said rotor shape undergoes planetary motion;

wherein said rotary machine is a multi-stage machine having a plurality of chambers between a fluid-facing surface of said rotor and a fluid-facing surface of said outer-member; and wherein said fluid-facing surface of said rotor comprises an at least one rotor solids-handling feature, and/or said fluid-facing surface of said outer-member comprises an at least one outer-member solids-handling feature.

11. The rotary machine of claim 10 wherein:

said rotor shape has n lobes, where n is an integer;

said outer-member shape has (n−1) lobes;

the pitch of said rotor is the same as the pitch of said outer-member; and the ratio of the lead of said rotor to the lead of said outer-member is n:(n−1).

12. The rotary machine of claim 11 wherein said hypotrochoidal shape is an ellipse, and n=2.

13. The rotary machine of claim 12 wherein:

said outer-member comprises an inverse apex region which, during operation of said rotary machine, contacts said fluid-facing surface of said rotor along a contact path; and said rotor comprises said at least one rotor solids-handling feature, said at least one rotor solids-handling feature comprising a plurality of grooves formed in said fluid-facing surface of said rotor and extending along a first helical path on said fluid-facing surface of said rotor; and wherein said first helical path is aligned with said contact path.

14. The rotary machine of claim 10 wherein, if present, said at least one rotor solids-handling feature comprises an at least one groove formed in said fluid-facing surface of said rotor and wherein, if present, said at least one outer-member solids-handling feature comprises an at least one groove formed in said fluid-facing surface of said outer-member.

15. The rotary machine of claim 10 wherein, if present, said at least one rotor solids-handling feature comprises a first plurality of grooves formed in said fluid-facing surface of said rotor and wherein, if present, said at least one outer-member solids-handling feature comprises a second plurality of grooves formed in said fluid-facing surface of said outer-member.

16. The rotary machine of claim 10 wherein, if present, said at least one rotor solids-handling feature comprises an at least one stitched groove formed in said fluid-facing surface of said rotor and wherein, if present, said at least one outer-member solids-handling feature comprises an at least one stitched groove formed in said fluid-facing surface of said outer-member.

17. The rotary machine of claim 10 wherein, if present, said at least one rotor solids-handling feature comprises a first plurality of indentations formed in said fluid-facing surface of said rotor and wherein, if present, said at least one outer-member solids-handling feature comprises a second plurality of indentations formed in said fluid-facing surface of said outer-member.

18. The rotary machine of claim 10 wherein, if present, said at least one rotor solids-handling feature is positioned asymmetrically in said fluid-facing surface of said rotor and wherein, if present, said at least one outer-member solids-handling feature is positioned asymmetrically in said fluid-facing surface of said outer-member.

19. The rotary machine of claim 10 wherein:

said rotor is configured to spin about said rotor axis;

said outer-member is configured to spin about said outer-member axis; and said rotor and said outer-member are held at a fixed eccentricity with said rotor axis offset relative to said outer-member axis so that, during operation of said rotary machine, said rotor undergoes planetary motion relative to said outer-member without orbiting.

20. The rotary machine of claim 10 wherein said rotary machine further comprises a seal mounted on said rotor, said seal comprising bristles extending from said fluid-facing surface of said rotor.

21. The rotary machine of claim 10 wherein, if present, said at least one rotor solids-handling feature is formed in said fluid-facing surface of said rotor and extends along a first helical path on said fluid-facing surface of said rotor and wherein, if present, said outer-member solids-handling feature is formed in said fluid-facing surface of said outer-member and extends along a second helical path on said fluid-facing surface of said outer-member.

22. A rotary machine comprising:

an outer-member; and a rotor disposed within said outer-member, said rotor having a rotor helical profile, and a rotor axis, and having a hypotrochoidal rotor shape at any cross-section transverse to said rotor axis along at least a portion of a length of said rotor that is hypotrochoidal, said rotor configured to undergo planetary motion relative to said outer-member; and said outer-member having an outer-member helical profile, an outer-member axis, and an outer-member shape at any cross-section transverse to said outer-member axis along at least a portion of a length of said outer-member that is an outer envelope formed when said hypotrochoidal rotor shape undergoes planetary motion;

wherein said hypotrochoidal rotor shape is an ellipse having 2 lobes, said outer-member shape has 1 lobe, the pitch of said rotor is the same as the pitch of said outer-member, and the ratio of the lead of said rotor to the lead of said outer-member is 2:1;

wherein said outer-member comprises an inverse apex which, during operation of said rotary machine, contacts a fluid-facing surface of said rotor along a contact path;

wherein said rotary machine is a multi-stage machine having a plurality of chambers between said fluid-facing surface of said rotor and a fluid-facing surface of said outer-member; and wherein said rotor comprises an at least one rotor solids-handling feature, said at least one rotor solids-handling feature comprising a plurality of grooves formed in said fluid-facing surface of said rotor and extending along a first helical path on said fluid-facing surface of said rotor; and wherein said first helical path is aligned with said contact path.

* * * * *